US008061822B2

(12) United States Patent
Kubo et al.

(10) Patent No.: US 8,061,822 B2
(45) Date of Patent: Nov. 22, 2011

(54) LIQUID DROPLET JETTING APPARATUS

(75) Inventors: Tomoyuki Kubo, Nagoya (JP); Takaichiro Umeda, Nagoya (JP); Ryuji Kato, Aisai (JP); Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 552 days.

(21) Appl. No.: 12/323,885

(22) Filed: Nov. 26, 2008

(65) Prior Publication Data

US 2009/0141071 A1 Jun. 4, 2009

(30) Foreign Application Priority Data

Nov. 30, 2007 (JP) ..... 2007-309963

(51) Int. Cl.
*B41J 2/175* (2006.01)
*B41J 2/155* (2006.01)

(52) U.S. Cl. ..... 347/85; 347/42

(58) Field of Classification Search ..... 347/85, 347/84, 42

See application file for complete search history.

(56) References Cited

U.S. PATENT DOCUMENTS 5,398,053 A * 3/1995 Hirosawa et al. ..... 347/13
6,179,406 B1 * 1/2001 Ito et al. ..... 347/35
6,203,148 B1 3/2001 Kishida
7,273,272 B2 9/2007 Inoue
7,597,415 B2 * 10/2009 Sugahara ..... 347/13
2008/0239013 A1 * 10/2008 Hirashima ..... 347/92
2009/0141074 A1 * 6/2009 Kubo et al. ..... 347/85
2009/0141094 A1 * 6/2009 Kubo et al. ..... 347/85

FOREIGN PATENT DOCUMENTS

JP 10-95129 4/1998
JP 10244681 A * 9/1998
JP 2005-306016 11/2005

* cited by examiner

*Primary Examiner* — Shelby Fidler
(74) *Attorney, Agent, or Firm* — Frommer Lawrence & Haug LLP

(57) ABSTRACT

A printer comprises a fixed line type first head, a serial type second head, an ink cartridge which stores an ink to be supplied to the first and second heads, a first cap which is to be installed to the first head, and a second cap which is to be installed to the second head. The ink cartridge and the first and second heads are connected in series in this order by using tubes. Accordingly, it is possible to shorten the lengths of the tubes. The serial type head, in which the drying is hardly caused from a nozzle and the influence is exerted to a small extent on the jetting performance when any viscosity-increased liquid and/or bubbles is/are supplied, is arranged on the downstream side. Accordingly, it is possible to decrease the frequency of the recovery operation.

13 Claims, 13 Drawing Sheets

LIQUID DROPLET JETTING APPARATUS

CROSS REFERENCE TO RELATED APPLICATION

The present application claims priority from Japanese Patent Application No. 2007-309963, filed on Nov. 30, 2007, the disclosure of which is incorporated herein by reference in its entirety.

BACKGROUND OF THE INVENTION

1. Field of the Invention

The present invention relates to a liquid droplet jetting apparatus for jetting liquid droplets.

2. Description of the Related Art

In general, an ink-jet printer, which records images, letters or the like on a recording medium such as the printing paper, comprises an ink-jet head (liquid droplet jetting head) which has nozzles for jetting liquid droplets of the ink, and an ink cartridge (liquid storage container, ink tank) for storing the ink to be used for the ink-jet head. Usually, the ink-jet head and the ink cartridge are connected to one another by means of a tube made of resin. The ink, which is stored in the ink cartridge, is supplied to the ink-jet head via the tube.

In recent years, it is investigated that a plurality of ink-jet heads, which jet an ink of the same type (same color), are provided in one printer, for example, in order to improve the recording speed. However, when a plurality of ink cartridges are provided in the printer corresponding to the plurality of ink-jet heads respectively, then the number of the ink cartridges is increased, the cost is increased, and the printer is large-sized. Therefore, it is preferable that the ink can be simultaneously supplied from one ink cartridge to the plurality of ink-jet heads.

Japanese Patent Application Laid-open No. 10-95129 discloses an ink cartridge provided with two ink supply ports. The two ink supply ports of the ink cartridge are connected in parallel to two ink-jet heads by means of two supply tubes (tubes). Therefore, it is possible to supply the ink of the same color to the two ink-jet heads respectively.

When one ink cartridge is connected to two ink-jet heads individually (in parallel) by means of a plurality of tubes, the total length of the tubes is consequently long as compared with a case in which one ink cartridge and two ink-jet heads are connected in series, which results in the increase in the cost. When the tubes are made of resin, and the tubes have the gas permeability to some extent, then the following problem arises. That is, the ink contained in the tubes is dried little by little, and the viscosity is increased (increase in viscosity), and/or the air bubbles make invasion into the tubes from the outside of the tubes. As described above, the ink containing a large amount of air bubbles and the viscosity-increased ink generated in the tubes bring about a large factor to cause the jetting failure in the nozzle. Therefore, when the total length of the tubes is increased as a result of the connection of the ink cartridge and the two ink-jet heads in parallel, then the amount of the ink subjected to the increase in viscosity in the tubes is increased, and/or the amount of air bubbles to make invasion into the tubes is increased. The jetting failure of the nozzle is frequently caused. In view of the above, the present inventors have investigated that one ink cartridge and two ink-jet heads are connected in series in order to shorten the total length of the tubes.

However, when one ink cartridge and two ink-jet heads are connected in series, the length of the tubes is increased for the ink to pass therethrough until arrival at one head of the heads from the ink cartridge in relation to the one head which is separated or disposed far from the ink cartridge and which is positioned on the more downstream side in the ink supply direction. Therefore, the viscosity-increased ink and/or the ink containing a large amount of bubbles is/are apt to be supplied to the one head which is disposed far from the ink cartridge. In other words, the jetting failure tends to arise in the nozzle of the one head which is separated far from the ink cartridge. It is necessary to frequently perform the recovery operation (restoring operation) for recovering the jetting performance in order to remove impurities such as the viscosity-increased ink and the air bubbles, the recovery operation including the purge operation for forcibly discharging the ink from the nozzle.

SUMMARY OF THE INVENTION

An object of the present invention is to shorten the length of the tubes by connecting a liquid tank and two liquid droplet jetting heads in series. Another object of the present invention is to decrease the frequency of the recovery operation by arranging, on the downstream side in the liquid supply direction, a head in which the drying (increase in viscosity) is hardly caused in a nozzle and which suffers less influence on the jetting performance even when the viscosity-increased liquid and/or the air bubbles is/are supplied.

According to an aspect of the present invention, there is provided a liquid droplet jetting apparatus which jets a droplet of a liquid onto an object, the liquid droplet jetting apparatus including:

a first head of a fixed line type in which a plurality of first nozzles arranged in one direction is formed and which jets the droplet of the liquid while being positioned and fixed at a predetermined position;

a second head of a serial type in which a plurality of second nozzles is formed and which is capable of reciprocating in a predetermined scanning direction;

a first cap which is attachable to the first head to cover the plurality of first nozzles;

a second cap which is attachable to the second head to cover the second nozzles;

a liquid tank which stores the liquid to be supplied to the first head and the second head;

a first tube which connects the first head and the liquid tank; and a second tube which connects the second head and the liquid tank, wherein the first head is connected to one end of the first tube and the liquid tank is connected to the other end of the first tube; and the second head is connected to the first head by the second tube such that the second head is connected to the liquid tank via the first head.

According to the aspect of the present invention, the second head is connected to the liquid tank via the first head. In other words, the liquid tank and the first and second heads are connected in series in this order in a liquid-supply direction. Therefore, it is possible to shorten the total length of the tubes as compared with a case in which the liquid tank and the two heads are connected by means of two tubes respectively (in parallel). Therefore, it is possible to reduce the cost required for the tubes. Further, it is also possible to suppress the increase in viscosity of the liquid in the tubes and the invasion of air bubbles into the tubes.

In the present invention, one head (first head) of the two heads is the fixed line type head, and the other head (second head) is the serial type head. The words "a plurality of first nozzles (are) arranged in one direction" in relation to the first head is not limited to a form in which the first nozzles are aligned linearly. The words also includes a form in which an array of the first nozzles is slightly curved and a form in which an array of the first nozzles somewhat meanders.

In general, in relation to the first head of the fixed line type having the large number of first nozzles, the first cap, which is installed to cover the plurality of first nozzles in order to prevent any drying when the liquid droplets are not jetted, is necessarily larger than the second cap which is installed to the second head. The tight contact performance of the first cap with respect to the head is inferior. Therefore, the nozzle drying (increase in viscosity of the liquid in the nozzle) originally tends to arise in the first head as compared with the second head. Even when the jetting failure occurs in only one of the large number of first nozzles due to the influence of the viscosity-increased liquid and the bubbles mixed from the outside, it is necessary to perform the recovery or restoring operation such as the purge for discharging the liquid from the first nozzle, in order to eliminate or dissolve the jetting failure. Further, when the recovery operation is frequently performed on condition that the number of nozzles is large, the amount of the liquid, which is discharged during the recovery operation, is extremely increased. As described above, it is affirmed that the first head of the fixed line type is such a head that the nozzles tend to be dried, the viscosity-increased liquid and/or the bubbles greatly affects or affect the jetting performance, and the head is relatively weak against the viscosity-increased liquid and the air bubbles.

On the other hand, in the case of the serial type second head which jets the liquid droplets while making the reciprocating movement in the scanning direction, in general, the number of the nozzles is not large so much as compared with the fixed line type first head, for the following reason. That is, it is unnecessary to provide a large number of nozzles, because the serial type head is movable by itself. Therefore, it is enough that the second cap member, which is installed to the second head in order to avoid the drying, is smaller than the first cap member, and the tight contact performance with respect to the head is satisfactory with such a second cap member. Therefore, the drying (increase in viscosity of the liquid) relatively hardly arises in the second nozzle. Further, in the case of the serial type head, when the jetting failure arises in a part of the nozzles, the nozzle, in which the jetting failure arises, can be also complemented or supplemented with any other nozzle by controlling, for example, the movement velocity (scanning velocity) of the head and/or the jetting timing of the other normal nozzle. Therefore, the jetting failure can be dealt with in some cases without performing the recovery operation. In other words, the drying of the nozzle hardly arises and the jetting performance is less affected when the viscosity-increased liquid and/or the bubbles is/are supplied in the serial type second head as compared with the fixed line type first head.

In view of the above, when the liquid tank and the two heads are connected in series, the first head, in which the drying of the nozzles tends to arise and which is weak against the viscosity-increased liquid and the air bubbles, is arranged on the near-side of the liquid tank (on the upstream side in the liquid-supply direction). Accordingly, it is possible to suppress the occurrence of the jetting failure even if the first head has the large number of first nozzles, and it is possible to decrease the frequency of the recovery operation such as the purge for recovering the jetting performance.

In the liquid droplet jetting apparatus of the present invention, an internal volume of the first cap may be larger than an internal volume of the second cap.

In this arrangement, the drying of the nozzle (increase in viscosity of the liquid in the nozzle) tends to arise in the first head as compared with the second head even when the cap member reliably makes tight contact with the head, because the first cap member, which is installed to the fixed line type first head, has the internal volume larger than the internal volume of the second cap member which is installed to the serial type second head. However, according to the present invention, the first head is arranged on the side of the liquid tank (on the upstream side in the liquid-supply direction) as compared with the second head. Therefore, the liquid, which has a low degree of the increase in viscosity and which contains a small amount of mixed bubbles as well, is supplied to the first head. The first nozzle of the first head is suppressed from the occurrence of the jetting failure.

In the liquid droplet jetting apparatus of the present invention, the first cap may be formed of a material having a gas permeability higher than that of a material forming the second cap. Specifically, the first cap may be formed of silicon rubber, and the second cap may be formed of isobutylene-isoprene rubber or copolymer of ethylene-propylene-diene monomer.

When the gas permeability of the first cap to be installed to the fixed line type first head is higher than the gas permeability of the second cap to be installed to the serial type second head, the drying of the nozzle (increase in viscosity of the liquid in the nozzle) tends to occur in the first head as compared with the second head, even when the cap member reliably makes tight contact with the head. However, according to the present invention, the first head is arranged on the side of the liquid storage container (on the upstream side in relation to the liquid supply) as compared with the second head. Therefore, the liquid, which has a low degree of the increase in viscosity and which contains a small amount of the mixed bubbles as well, is supplied to the first head. The occurrence of the jetting failure is suppressed in the first nozzle of the first head. When the first cap is formed of silicon rubber, and the second cap is formed of isobutylene-isoprene rubber or copolymer of ethylene-propylene-diene monomer, then the gas permeability of the second cap can be suppressed to be low. Even when the first cap is relatively large as compared with the second cap, the first cap can be produced by using silicon rubber which is relatively cheap and which is excellent in the handling performance.

In the liquid droplet jetting apparatus of the present invention, the first tube may have a bendability smaller than that of the second tube.

The fixed line type first head is positioned and fixed at least during the liquid droplet jetting operation. Therefore, the bendability or flexibility is not required so much for the first tube which connects the liquid tank and the first head as compared with the second tube which connects the first head and the serial type second head. Therefore, the gas permeation through the first tube can be decreased by increasing the wall thickness of the first tube or by using a material such as a metal having the high rigidity. It is possible to suppress the increase in viscosity of the liquid in the first tube and the invasion of air bubbles.

In the liquid droplet jetting apparatus of the present invention, the first head may include a head body in which the plurality of first nozzles is formed; and a liquid storage member which is provided integrally with the head body, which is connected to the liquid tank by the first tube, and which stores the liquid supplied from the liquid tank; and the second head and the liquid storage member of the first head may be connected by the second tube.

The first head is provided with the liquid storage member which temporarily stores the liquid, and the liquid storage member is connected to the second head by means of the second tube. Therefore, it is possible to avoid the occurrence of the shortage of the liquid to be supplied to the second head. Further, it is also possible to attenuate the pressure fluctuation of the liquid, which would be otherwise caused when the serial type second head makes the reciprocating movement.

In the liquid droplet-jetting apparatus of the present invention, the second tube, which is connected to the second head, may be connected to a central portion of the first head in the scanning direction.

The second tube extends toward the second head from the central portion of the first head in the movement direction (scanning direction) of the second head. Therefore, it is possible to decrease the bending amount of the second tube when the second head arrives at the positions of the both ends in the movement range. It is possible to decrease the space required for the bent second tube to escape. Further, it is also possible to shorten the length of the second tube.

The liquid droplet-jetting apparatus of the present invention may further include a purge mechanism which has a cap-driving mechanism which drives the first and second caps so that the first and second caps are capable of coming into contact with and separating away from the first and second heads, respectively, and a sucking mechanism connected to the first and second caps to evacuate a first space and a second space, the first space being defined by the first cap and a first nozzle surface formed with the first nozzles of the first head, and a second space being defined by the second cap and a second nozzle surface formed with the second nozzles of the second head.

In this arrangement, the purge process can be performed for the nozzle in which the jetting failure arises, for example, due to the viscosity-increased liquid and/or the air bubbles. It is possible to recover or restore the jetting characteristic of the nozzle.

In the liquid droplet-jetting apparatus of the present invention, a volume of the first space may be larger than a volume of the second space. In this arrangement, the drying of the nozzle (increase in viscosity of the liquid in the nozzle) tends to arise in the first head as compared with the second head even when the cap reliably makes tight contact with the head, because the volume of the first space is larger than the volume of the second space. However, according to the present invention, the first head is arranged on the near-side of the liquid tank (on the upstream side in the liquid-supply direction) as compared with the second head. Therefore, the liquid, which has a low degree of the increase in viscosity and which contains a small amount of mixed bubbles as well, is supplied to the first head. The first nozzle of the first head is suppressed from the occurrence of the jetting failure.

In the liquid droplet-jetting apparatus of the present invention, the sucking mechanism may have a suction pump, and a switch which switches a connection target of the suction pump between the first space and the second space.

In this arrangement, for example, when the jetting failure arises in only one head of the first and second heads, the purge process can be performed for only one head. It is possible to avoid any consumption of useless liquid droplets. In such a situation, one suction pump can be used for the two heads while being switched. Therefore, it is unnecessary to prepare suction pumps of the same number as that of the heads. It is possible to miniaturize the liquid droplet-jetting apparatus.

In the liquid droplet-jetting apparatus of the present invention, a number of the first nozzles may be more than a number of the second nozzles. Further, the first nozzles of the first head may cover a range entirely in which the second head is capable of reciprocating in the scanning direction. In these cases, the first head can be longer than the second head, and the first head can cover the same range as the second head in the scanning direction.

In the liquid droplet-jetting apparatus of the present invention, the liquid may be an ink, and each of the first and second heads may be a piezoelectric type ink-jet head which jets a droplet of the ink onto the object.

According to the present invention, the second head is connected to the liquid tank via the first head. In other words, the liquid tank and the first and second heads are connected in series. Therefore, it is possible to shorten the total length of the tubes as compared with a case in which the liquid tank and the two heads are connected by means of two tubes respectively (connected in parallel). Therefore, it is possible to reduce the cost required for the tubes. Further, it is also possible to suppress the increase in viscosity of the liquid in the tubes and the invasion of air bubbles into the tubes.

Further, the first head, in which the drying of the nozzle tends to arise and which is weak against the viscosity-increased liquid and the air bubbles, is arranged on the side of the liquid tank (on the upstream side in relation to the liquid supply). Accordingly, it is possible to suppress the occurrence of the jetting failure in the first head having the large number of first nozzles. It is possible to decrease the frequency of the recovery operation for recovering the jetting performance.

DESCRIPTION OF THE PREFERRED EMBODIMENTS

Next, an embodiment of the present invention will be explained. This embodiment is an example in which the present invention is applied to a printer provided with two types of heads, i.e., a fixed type line head and a serial head.

Figure 1:
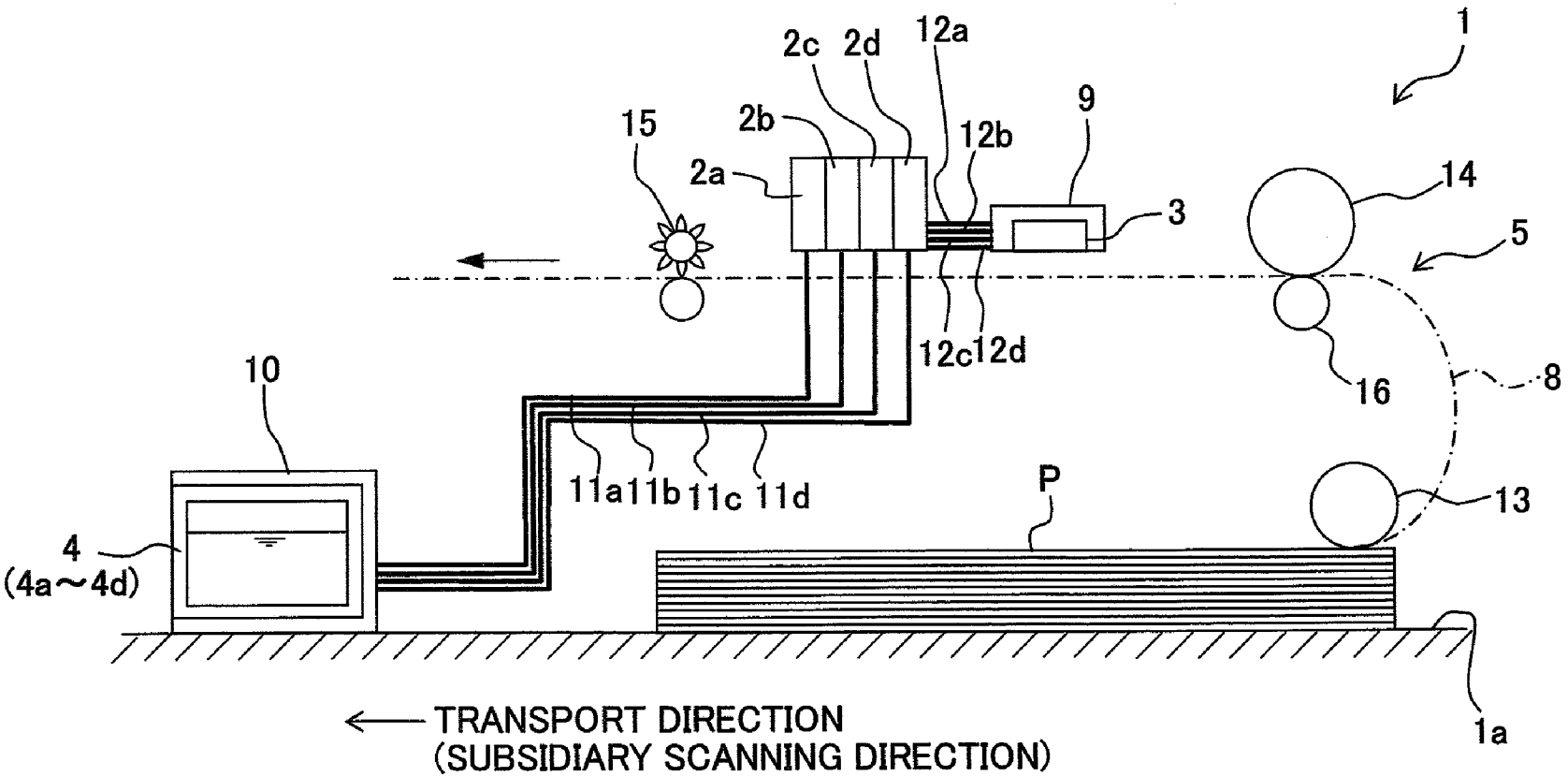
FIG. 1 shows a side view illustrating a schematic arrangement of a printer according to an embodiment of the present invention.
Figure 2:
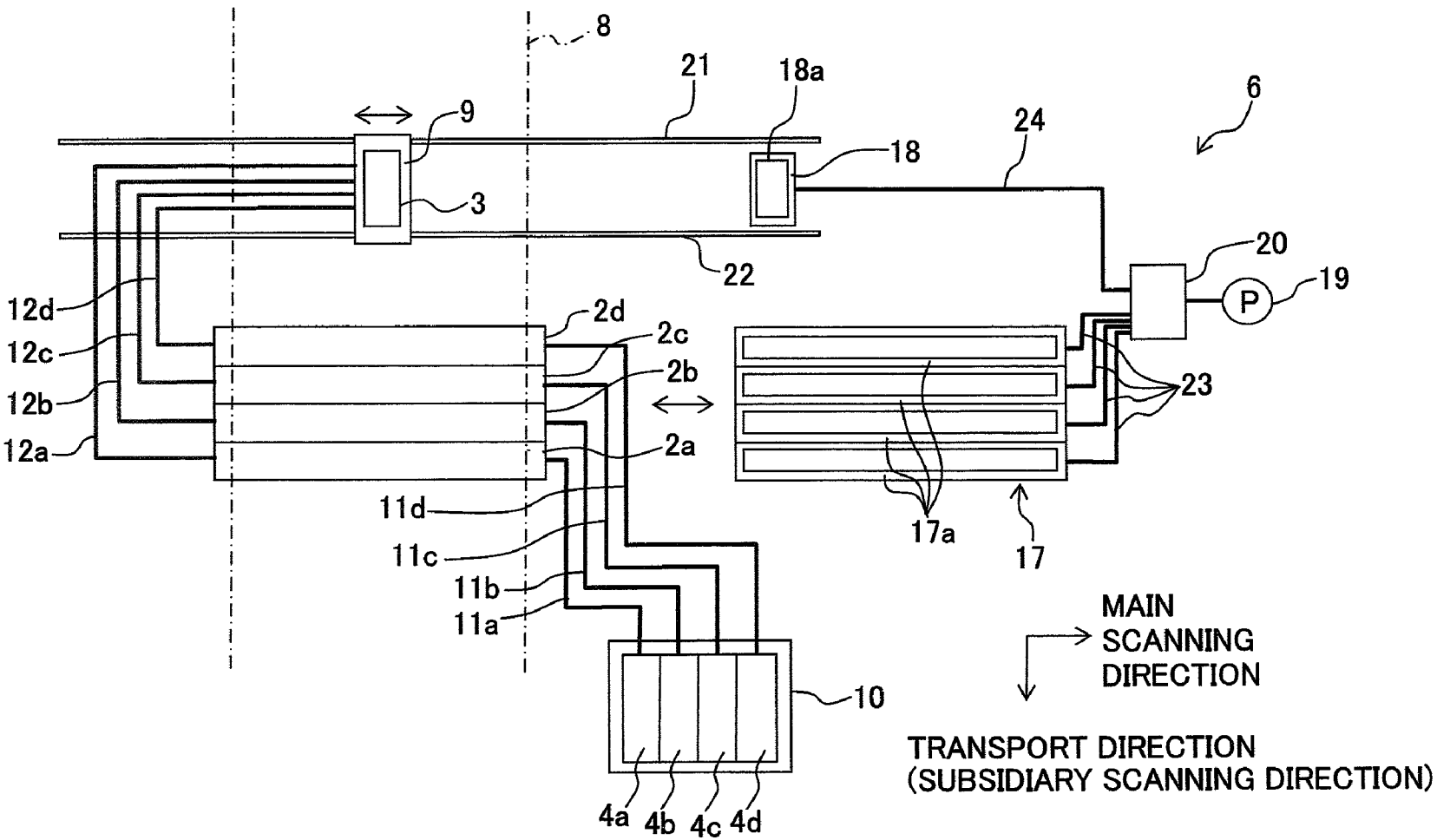
FIG. 2 shows a plan view illustrating the printer shown in FIG. 1.

FIG. 1 shows a schematic side view illustrating the printer 1 of this embodiment. FIG. 2 shows a plan view illustrating the printer 1 shown in FIG. 1. In FIG. 2, for example, rollers 13, 14, 15 shown in FIG. 1 are omitted from the illustration.

Overall Arrangement of Printer

As shown in FIGS. 1 and 2, the printer 1 (liquid droplet-jetting apparatus) of this embodiment comprises, for example, four first heads 2*a* to 2*d* of fixed line type (first liquid droplet-jetting heads), a serial type second head 3 (second liquid droplet-jetting head); four ink cartridges 4*a* to 4*d* (liquid storage containers, liquid tanks) which store four types (four colors) of inks respectively, a printing paper transport mechanism 5 (transport mechanism) which transports the printing paper P along a printing paper transport path 8 (depicted by an alternate long and short dash line in FIG. 1) which is disposed under or below the first heads 2 and the second head 3, a maintenance mechanism 6 which performs the maintenance for the first heads 2 and the second head 3, and a control unit 7 (see FIG. 12) which manages the overall control of the printer 1. In the following description, when the first heads 2*a* to 2*d* are not distinguished from each other, they are collectively referred to as "first heads 2".

Nozzle arrays, each of which includes a plurality of first nozzles 55*a* (see FIGS. 6 and 7) arranged in the printing paper widthwise direction (main scanning direction: direction perpendicular to the plane of paper of FIG. 1, left-right direction in FIG. 2) perpendicular to the transport direction of the printing paper P, are formed on the lower surface of each of the fixed line type first heads 2. When the first nozzles 55*a* and second nozzles 55*b* described later on are not distinguished from each other, they are collectively referred to as "nozzles 55". Each of the first heads 2 jets the liquid droplets from the plurality of first nozzles 55 respectively while being positioned and fixed at the predetermined liquid droplet jetting position. The four first heads 2*a* to 2*d* jet the four color inks of yellow, magenta, cyan, and black from the first nozzles 55 respectively. The four first heads 2*a* to 2*d* are arranged and aligned in the printing paper transport direction (subsidiary scanning direction). The specified structure of the first heads 2 will be explained in detail later on.

The serial type second head 3 is carried on a carriage 9 which is movable along two guide shafts 21, 22 in the printing paper widthwise direction (main scanning direction). When the carriage 9 is driven by a carriage-driving motor 125 (see FIG. 12), the second head 3 makes the reciprocating movement integrally with the carriage 9. Four arrays of nozzle arrays 101 (see FIGS. 9 to 11), each of which includes a plurality of second nozzles 100 arranged in the transport direction of the printing paper P, are formed on the lower surface of the second head 3. The four arrays of the second nozzles 100 jet the four color inks of yellow, magenta, cyan, and black respectively. The specified structure of the second head 3 will be also explained in detail later on.

The inks of four colors of yellow, magenta, cyan, and black are stored in the four ink cartridges 4*a* to 4*d* respectively. The four ink cartridges 4*a* to 4*d* are detachably installed to a holder 10 provided fixedly on the bottom surface 1*a* of the printer body respectively. When the four ink cartridges 4*a* to 4*d* are not distinguished from each other, they are collectively referred to as "ink cartridges 4".

The four ink cartridges 4*a* to 4*d* and the four first heads 2*a* to 2*d* are connected by means of four first tubes 11*a* to 11*d* composed of a synthetic resin material or the like respectively. The four first heads 2*a* to 2*d* and the second head 3 are connected by means of four second tubes 12*a* to 12*d* composed of a synthetic resin material or the like as well. In other words, the second head 3 is connected to the ink cartridges 4 by the aid of (via) the first heads 2. In other words, the ink cartridges 4 each of which stores the ink of a certain type and one of the first heads 2 and the second head 3 which use the ink are connected in series in an order of the ink cartridges 4, the first heads 2, and the second head 3.

In this arrangement, the fixed line type first heads 2 are positioned and fixed at least when the liquid droplets are jetted. Therefore, the bendability or flexibility is not required so much for the four first tubes 11*a* to 11*d* which connect the ink cartridges 4 and the first heads 2, as compared with the four second tubes 12*a* to 12*d* which connect the first heads 2 and the second head 3 that makes the reciprocating movement when the liquid droplets are jetted. Therefore, it is possible to decrease the gas permeability of the first tubes 11*a* to 11*d*, for example, such that the wall thicknesses of the first tubes 11*a* to 11*d* are increased and/or a material such as a metal having the high rigidity is used. It is possible to suppress the invasion of air bubbles and the increase in viscosity of the inks in the first tubes 11*a* to 11*d*.

The printing paper transport mechanism 5 is provided with, for example, a paper feed roller 13, a main roller 14, a spur roller 15, and driving motors 122, 123, 124 (see FIG. 12) which drive the rollers 13, 14, 15 respectively. The printing paper transport mechanism 5 transports the printing paper P along the printing paper transport path 8. That is, one sheet is extracted from stacked sheets of the printing paper P by means of the paper feed roller 13. The extracted printing paper P is transported to the first heads 2 and the second head 3 by means of the cooperation of the main roller 14 and a press roller 16. Further, the printing paper P is discharged by the spur roller 15 after printing, for example, the image by the first heads 2 and the second head 3.

As shown in FIG. 2, the maintenance mechanism 6 is provided with, for example, first cap members 17 which are to be installed to the first heads 2, a second cap member 18 which is to be installed to the second head 3, and a suction pump 19 which is connected to the first cap members 17 and the second cap member 18 respectively. The maintenance mechanism 6 prevents the nozzles of the both heads from being dried in the waiting state in which the liquid droplets are not jetted, by covering the lower surfaces (liquid droplet jetting surfaces) of the first heads 2 and the second head 3 with the first cap members 17 and the second cap member 18 respectively. If the abnormal jetting arises in the nozzle of any one of the heads by any chance, the suction purge is performed to suck the ink from the nozzles by means of the suction pump 19 to recover or restore the liquid droplet jetting performance of the concerning heads. The maintenance mechanism will be explained in detail later on.

Structure of First Heads

Figure 3:
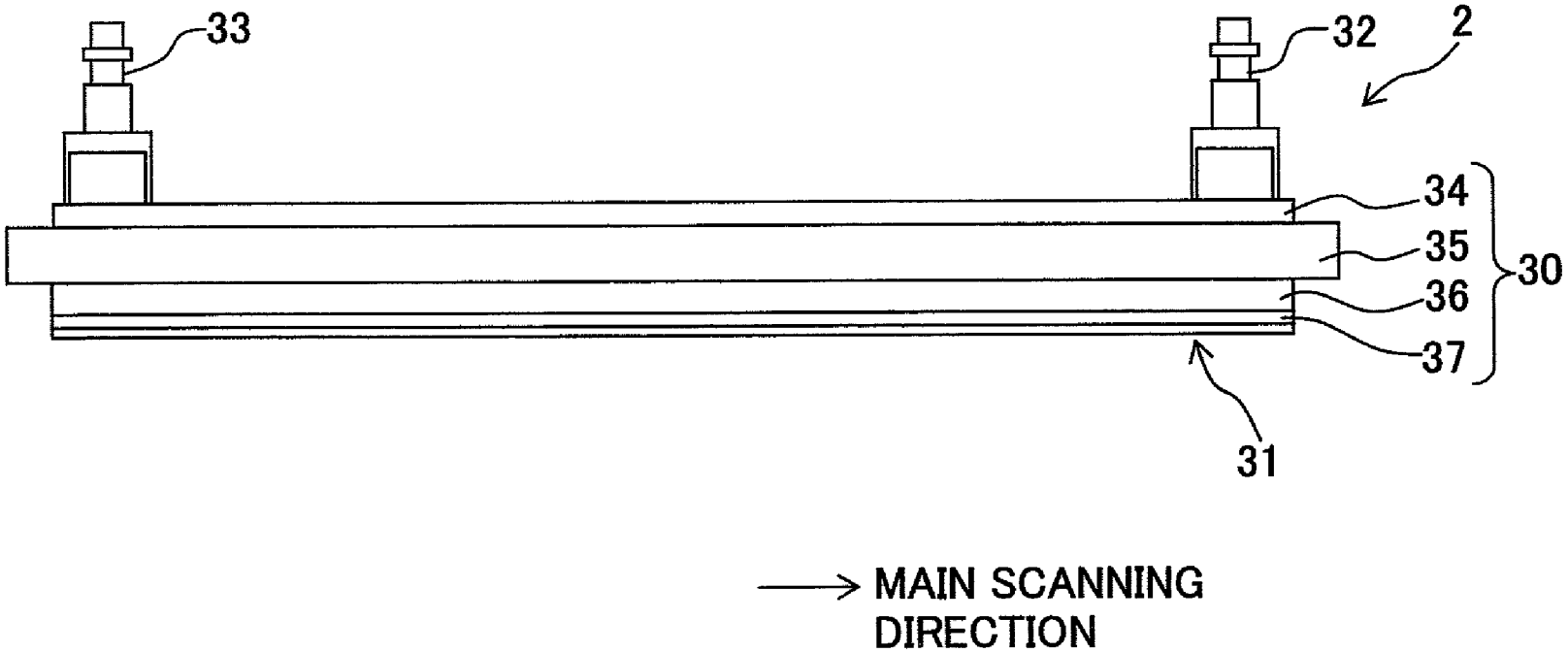
FIG. 3 shows a front view illustrating a first head.

Next, the structure of the fixed line type first heads 2 will be explained in detail. All of the four first heads 2*a* to 2*d* have the same structure. Therefore, the following description will be made about one of the first heads 2. FIG. 3 shows a front view illustrating one of the first heads 2, and FIG. 4 shows a vertical sectional view illustrating the one of the first heads 2 shown in FIG. 3.

Figure 4:
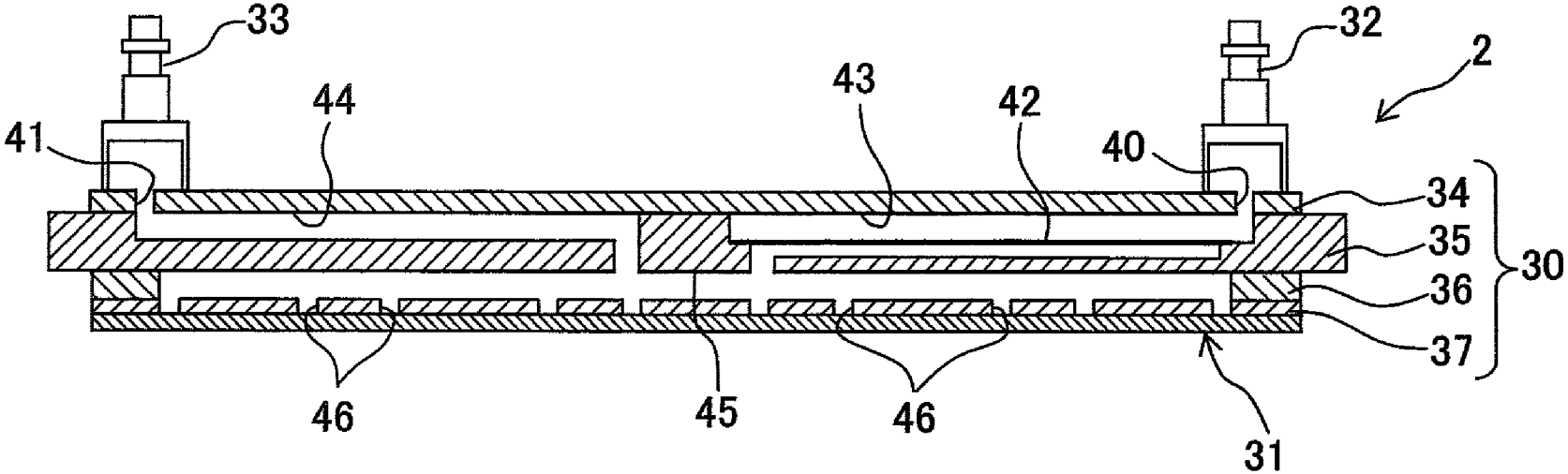
FIG. 4 shows a vertical sectional view illustrating the first head shown in FIG. 3.
Figure 6:
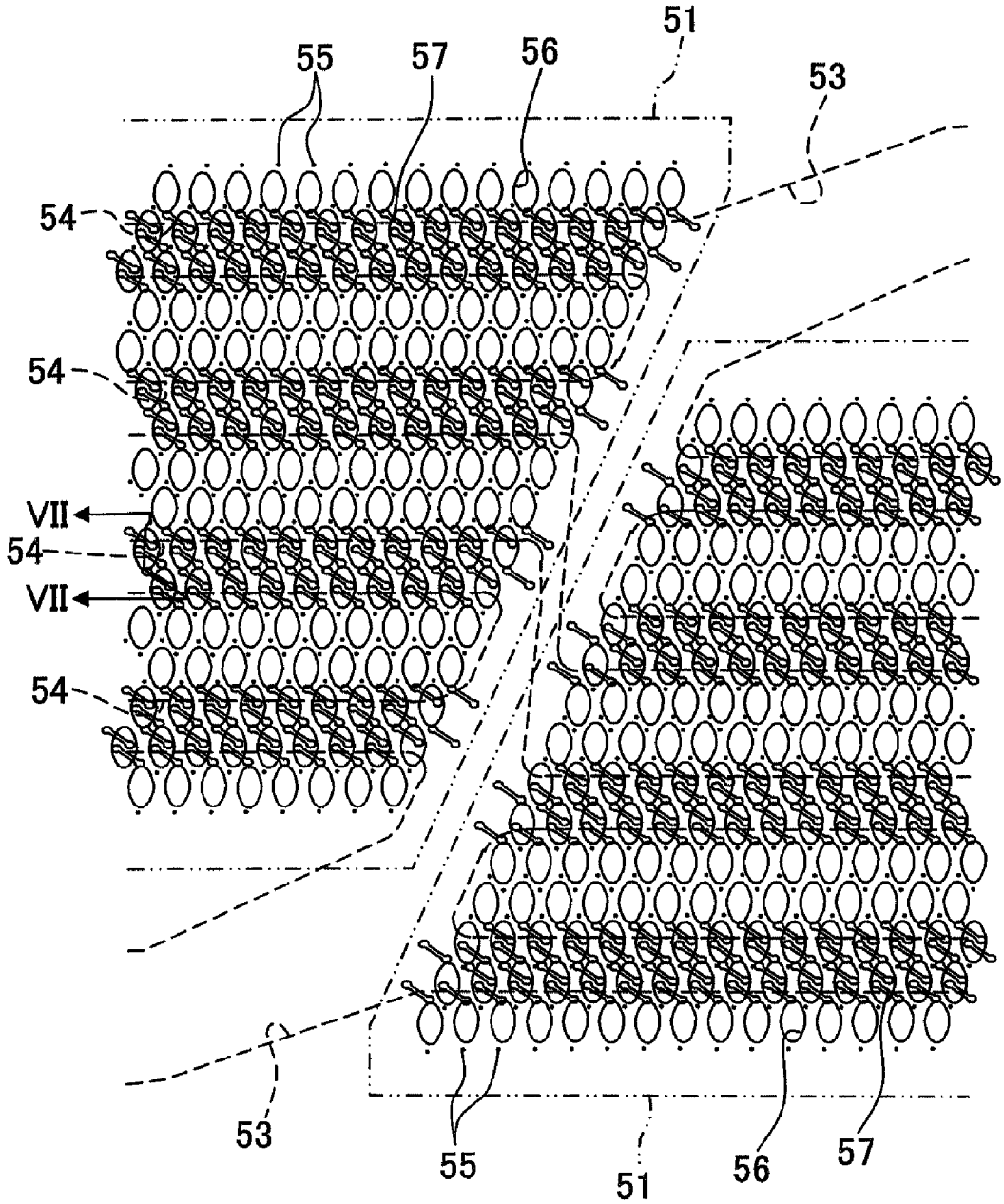
FIG. 6 shows a magnified view illustrating an area surrounded by alternate long and short dash lines shown in FIG. 5.
Figure 7:
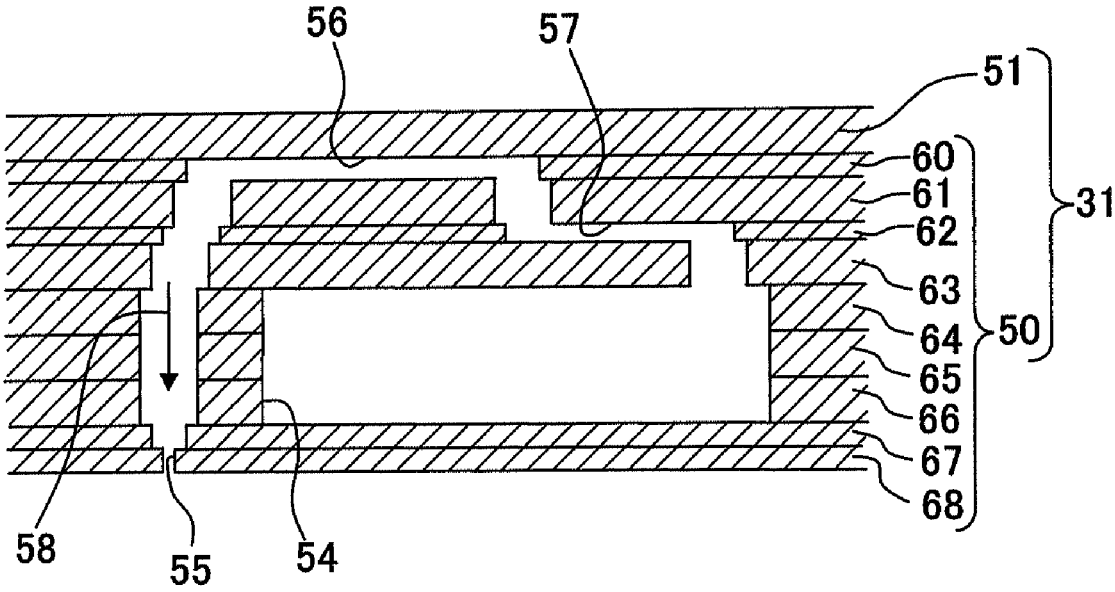
FIG. 7 shows a partial sectional view taken along a line VII-VII shown in FIG. 6.

As shown in FIGS. 3 and 4, each of the first heads 2 includes a reservoir unit 30 (liquid storage member) which has an ink inlet section 32 and an ink outlet section 33, and a head body 31 which is joined to the lower surface of the reservoir unit 30 to be integrated into one unit and which is formed with the plurality of first nozzles 55 (see FIGS. 6 and 7).

At first, the reservoir unit 30 will be explained. As shown in FIGS. 3 and 4, the reservoir unit 30 is a stack of four plates 34 to 37 each of which is elongated in the printing paper widthwise direction (main scanning direction). The ink inlet section 32 and the ink outlet section 33 are provided at the both ends in the longitudinal direction of the uppermost plate 34. The ink inlet section 32 is connected to one of the ink cartridges 4 via one of the first tubes 11 (see FIGS. 1 to 3). The ink outlet section 33 is connected to the second head 3 via one of the second tubes 12 (see FIGS. 1 to 3).

As shown in FIG. 4, through-holes 40, 41, which are communicated with the ink inlet section 32 and the ink outlet section 33 respectively, are formed through the plate 34. The second plate 35, which is counted from the uppermost position, is formed with a filter-accommodating space 43 which is connected to the ink inlet section 32 via the through-hole 40 and which accommodates a filter 42 for removing impurities such as the dust and the air bubbles contained in the ink, and an ink outlet passage 44 which is connected to the ink outlet section 33 via the through-hole 41 and in which a recess formed by the half etching and a hole connected to the recess are formed. The third plate 36, which is counted from the uppermost position, is formed with an ink reservoir 45 which extends to cover the substantially entire region in relation to the longitudinal direction (main scanning direction) and which temporarily stores the ink supplied from the ink cartridges 4. The ink reservoir 45 is communicated with both of the filter-accommodating space 43 and the ink outlet passage 44 which are formed for the plate 35 disposed just above. Further, the lowermost plate 37 is formed with a plurality of ink supply holes 46 which make communication between the ink reservoir 45 and the head body 31.

Therefore, the ink, which is supplied from the ink cartridges 4 via the first tubes 11 to the first heads 2, is introduced into the ink reservoir 45 from the ink inlet section 32 via the through-hole 40 and the filter-accommodating space 43. The ink, which is contained in the ink reservoir 45, is supplied from the plurality of ink supply holes 46 to the head body 31. On the other hand, a part of the ink, which is contained in the ink reservoir 45, is derived to the second head 3 from the ink outlet section 33 via the ink outlet passage 44.

The ink inlet section 32 to which the ink is supplied from the ink cartridges 4 and the ink outlet section 33 which is provided to supply the ink to the second head 3 are provided at the both ends in the longitudinal direction of the reservoir unit 30 respectively. Therefore, the ink, which is supplied to one end (right end as shown in FIGS. 3 and 4) of each of the first heads 2, is supplied to the second head 3 from the other end (left end as shown in FIGS. 3 and 4) of the first heads 2. Therefore, the flow of the ink, which is directed from one end to the other end, is generated in each of the first heads 2. The air bubbles, which are mixed in the ink, hardly stay in the first heads 2.

The fixed line type first head 2 is provided with the reservoir unit 30 (liquid storage member) formed with the ink reservoir 45 for temporarily storing the ink. The first heads 2 are connected to the second head 3 disposed on the downstream side, at the ink outlet section 33 of the reservoir unit 30. Therefore, the ink, which is once stored in the ink reservoir 45, is supplied to the second head 3. It is possible to avoid the occurrence of any shortage of the ink to be supplied to the second head 3. The second head 3 is the serial type head which jets the liquid droplets while making the reciprocating movement in the printing paper widthwise direction. The pressure fluctuation of the ink, which is generated when the second head 3 makes the reciprocating movement, can be attenuated by the ink reservoir 45 as well.

Figure 5:
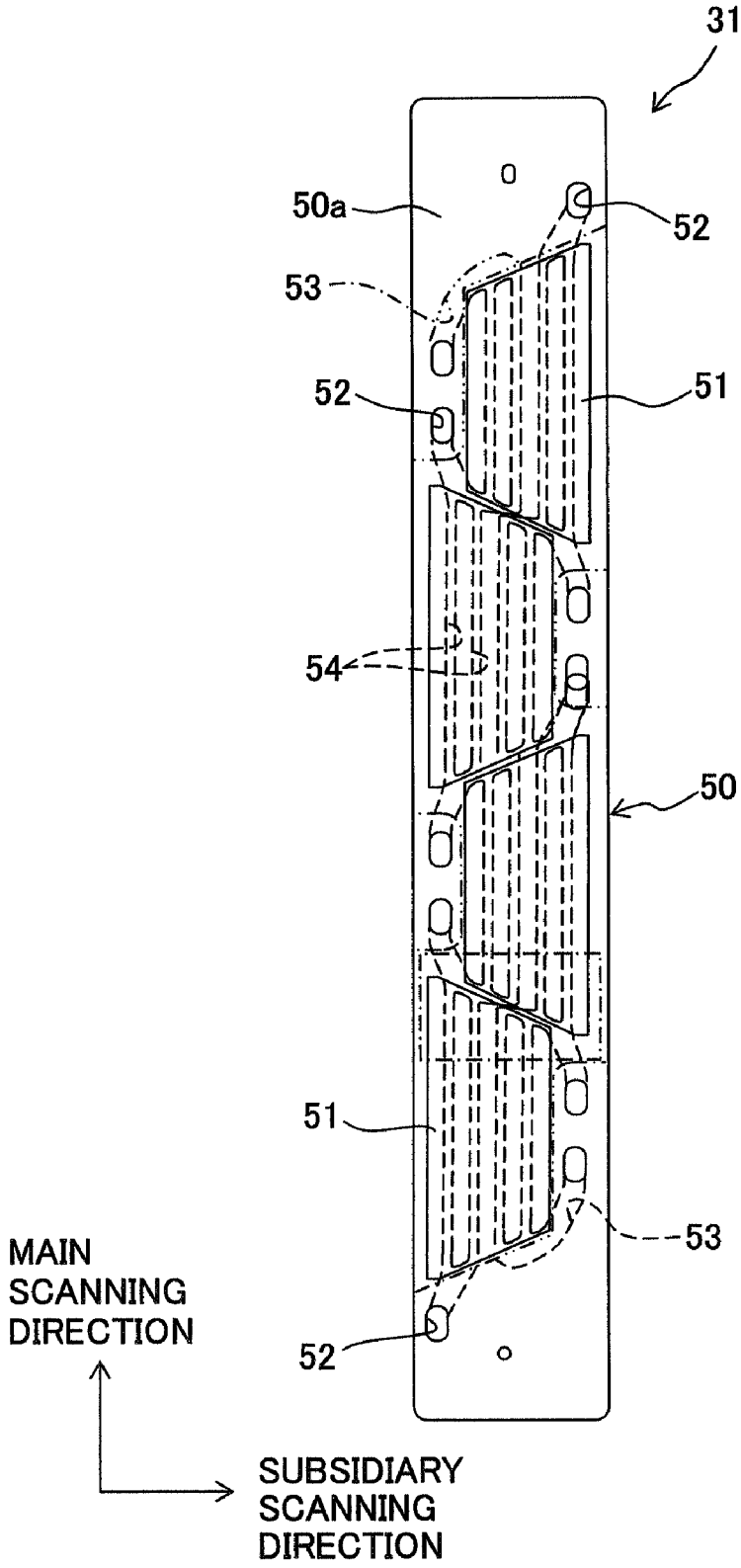
FIG. 5 shows a plan view illustrating a head body.
Figure 8A:
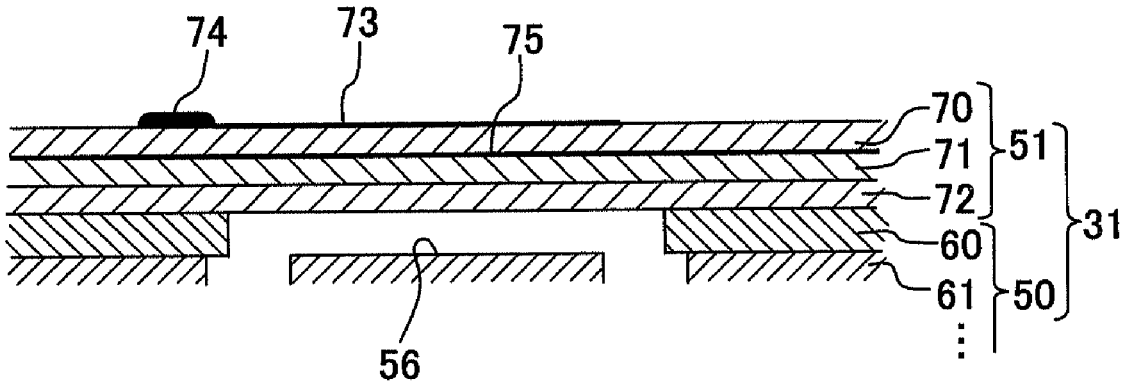
FIG. 8A shows a magnified sectional view illustrating an actuator unit.
Figure 8B:
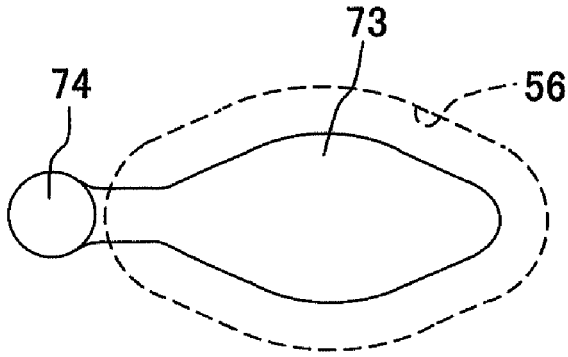
FIG. 8B shows a plan view illustrating an individual electrode shown in FIG. 8A.

Next, the head body 31 will be explained. FIG. 5 shows a plan view illustrating the head body 31. FIG. 6 shows a magnified view illustrating the area surrounded by alternate long and short dash lines shown in FIG. 5. In FIG. 6, for the purpose of convenience of the explanation, the pressure chambers 56, the apertures 57, and the first nozzles 55, which are disposed under or below the actuator unit 51 and which are to be depicted by broken lines, are depicted by solid lines. FIG. 7 shows a partial sectional view taken along a VII-VII line shown in FIG. 6. FIG. 8A shows a magnified sectional view illustrating the actuator unit 51. FIG. 8B shows a plan view illustrating one of the individual electrodes 73 shown in FIG. 8A.

As shown in FIG. 5, the head body 31 includes a flow passage unit 50 which is formed with ink flow passages including the first nozzles 55 and the pressure chambers 56, and four actuator units 51 which are fixed to the upper surface 50*a* of the flow passage unit 50 and which apply the pressure to the ink contained in the pressure chambers 56.

The flow passage unit 50 is formed to have a rectangular parallelepiped shape which has approximately the same as the shape of the reservoir unit 30 described above (see FIGS. 3 and 4) as viewed in a plan view. A plurality of ink supply ports 52 (ten ports in this embodiment), which correspond to the plurality of ink supply holes 46 (see FIG. 4) of the reservoir unit 30, are open on the upper surface 50*a* of the flow passage unit 50. Manifold flow passages 53 communicated with the ink supply ports 52 and subsidiary manifold flow passages 54 branched from the manifold flow passages 53 are formed in the flow passage unit 50. The lower surface of the flow passage unit 50 is the liquid droplet-jetting surface or a nozzle surface. As shown in FIGS. 6 and 7, the plurality of first nozzles 55*a* are arranged in a matrix form in the two directions of the main scanning direction and the direction intersecting the main scanning direction. The plurality of pressure chambers 56 are also arranged in a matrix form in the same manner as the first nozzles 55 on the fixed surface of the actuator unit 51 of the flow passage unit 50.

As shown in FIG. 7, the flow passage unit 50 includes nine metal plates such as stainless steel plates, i.e., a cavity plate 60, a base plate 61, an aperture plate 62, a supply plate 63, manifold plates 64, 65, 66, a cover plate 67, and a nozzle plate 68. The plates are stacked in this order from the upper position.

The cavity plate 60 is formed with a plurality of through-holes which correspond to the ink supply ports 52 (see FIG. 5), and a plurality of substantially rhombic shaped pressure chambers 56. The base plate 61 is formed with communication holes which make communication between the pressure chambers 56 and the apertures 57, communication holes which make communication between the pressure chambers 56 and the first nozzles 55, and communication holes (not shown) which make communication between the ink supply ports 52 and the manifold flow passages 53, in relation to the respective pressure chambers 56.

The aperture plate 62 is formed with through-holes which are to be the apertures 57, communication holes which make communication between the pressure chambers 56 and the nozzles 55, and communication holes (not shown) which make communication between the ink supply ports 52 and the manifold flow passages 53, in relation to the respective pressure chambers 56. The supply plate 63 is formed with communication holes which make communication between the apertures 57 and the subsidiary manifold flow passages 54, communication holes which make communication between the pressure chambers 56 and the first nozzles 55, and communication holes (not shown) which make communication between the ink supply ports 52 and the manifold flow passages 53, in relation to the respective pressure chambers 56.

The manifold plates 64, 65, 66 are formed with communication holes which make communication between the pressure chambers 56 and the nozzles 55 and through-holes which serve as the manifold flow passages 53 and the subsidiary manifold flow passages 54 by being connected to one another upon the stacking, in relation to the respective pressure chambers 56. The cover plate 67 is formed with communication holes which make communication between the pressure chambers 56 and the first nozzles 55 in relation to the respective pressure chambers 56. The nozzle plate 68 is formed with the first nozzles 55 corresponding to the respective pressure chambers 56.

The manifold flow passages 53, the subsidiary manifold flow passages 54, and the plurality of individual ink flow passages 58 extending from the outlets of the subsidiary manifold flow passages 54 via the pressure chambers 56 to the first nozzles 55 are formed in the flow passage unit 50 by stacking the plates 60 to 68 while being mutually positioned.

Therefore, the ink, which is supplied into the flow passage unit 50 from the reservoir unit 30 via the ink supply ports 52, is distributed from the manifold flow passages 53 to the subsidiary manifold flow passages 54. Further, the ink, which is contained in the subsidiary manifold flow passages 54, is allowed to flow into the plurality of individual ink flow passages 58 respectively. The ink arrives at the first nozzles 55 via the apertures 57 to serve as throttle flow passages and the pressure chambers 56 in the respective individual ink flow passages 58.

Next, the actuator unit 51 will be explained. As shown in FIG. 5, the four actuator units 51 have trapezoidal shapes as viewed in a plan view respectively. The actuator units 51 are arranged in a zigzag form so that they are not overlapped with the ink supply ports 52. Two sides of the four sides of each of the actuator units 51, which are opposed to one another in parallel, extend in the longitudinal direction of the flow passage unit 50. Oblique sides of the adjoining actuator units 51 are overlapped with each other in the widthwise direction (subsidiary scanning direction) of the flow passage unit 50.

As shown in FIG. 8A, the actuator unit 51 has three piezoelectric sheets 70, 71, 72 each of which is composed of a piezoelectric ceramics material of the lead titanate zirconate (PZT) system having the ferroelectricity. The piezoelectric sheet 70, which is disposed at the uppermost layer of the three piezoelectric sheets 70, 71, 72, is polarized in the thickness direction thereof.

The individual electrodes 73 are formed at the positions each of which is overlapped with one of the pressure chambers 56 and each of which is disposed on the upper surface of the piezoelectric sheet 70. A common electrode 75, which is formed to cover the surface of the sheet entirely, is allowed to intervene between the piezoelectric sheet 70 of the uppermost layer and the piezoelectric sheet 71 disposed therebelow. As shown in FIG. 8B, each of the individual electrodes 73 has a substantially rhombic shape which is similar to the pressure chambers 56 as viewed in a plan view. One of two acute angle portions of each of the substantially rhombic individual electrodes 73 extends outwardly. A circular land 74, which is electrically connected to each of the individual electrode 73, is provided at the forward end of the one of the acute angle portions.

The common electrode 75 is maintained at the ground electric potential, therefore an area of the common electrode 75 corresponding to all of the pressure chambers 56 is maintained at the ground electric potential. On the other hand, the respective lands 74 are connected to respective terminals of a driver IC 76 (see FIG. 12) by the aid of unillustrated Flexible Printed Circuit (FPC). Therefore, the driver IC 76 is capable of selectively controlling the electric potentials of the individual electrodes 73.

The function of the actuator unit 51 constructed as described above will now be described. When the electric potential, which is different from that of the common electrode 75, is applied to the individual electrodes 73, the electric field is applied in the direction of polarization of the piezoelectric sheet 70. In this situation, the portion of the piezoelectric sheet 70, to which the electric field is applied, acts as the active portion, and the active portion is distorted (deformed) in accordance with the piezoelectric effect. As shown in FIG. 8A, the piezoelectric sheets 70 to 72 are fixed to the surface of the cavity plate 60 which comparts the pressure chambers 56. A difference appears in the distortion in the in-plane direction between the electric potential-applied portion of the piezoelectric sheet 70 and the piezoelectric sheets 71, 72 disposed therebelow. Therefore, the piezoelectric sheets 70 to 72 cause the deformation (unimorph deformation) as a whole so that the piezoelectric sheets 70 to 72 deform to be convex toward the pressure chambers 56. Accordingly, the volume of the pressure chambers 56 is decreased, the pressure (jetting energy) is applied to the ink contained in the pressure chambers 56, and the ink droplets are jetted from the first nozzles 55.

Structure of Second Head

Figure 9:
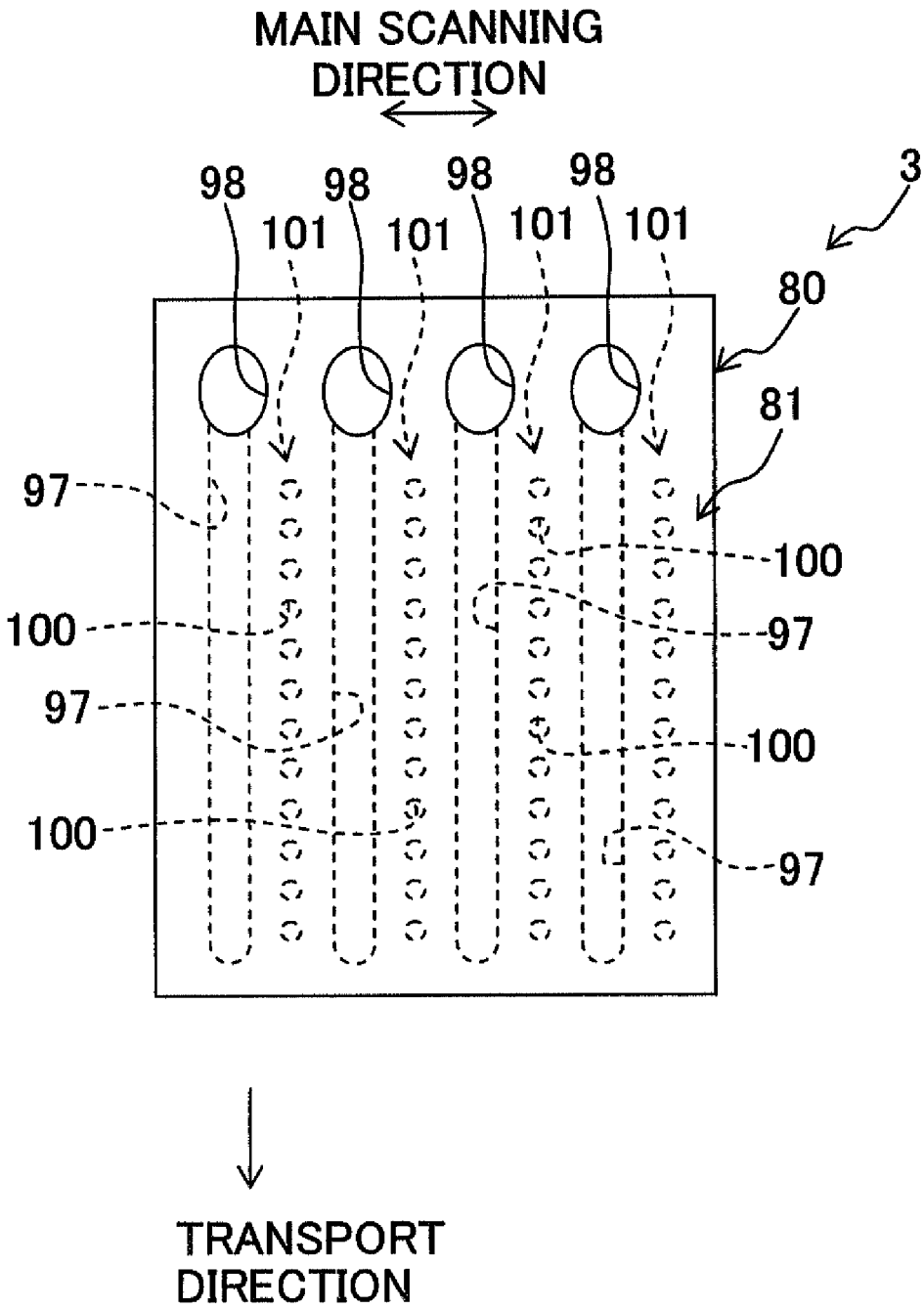
FIG. 9 shows a plan view illustrating a second head.
Figure 10:
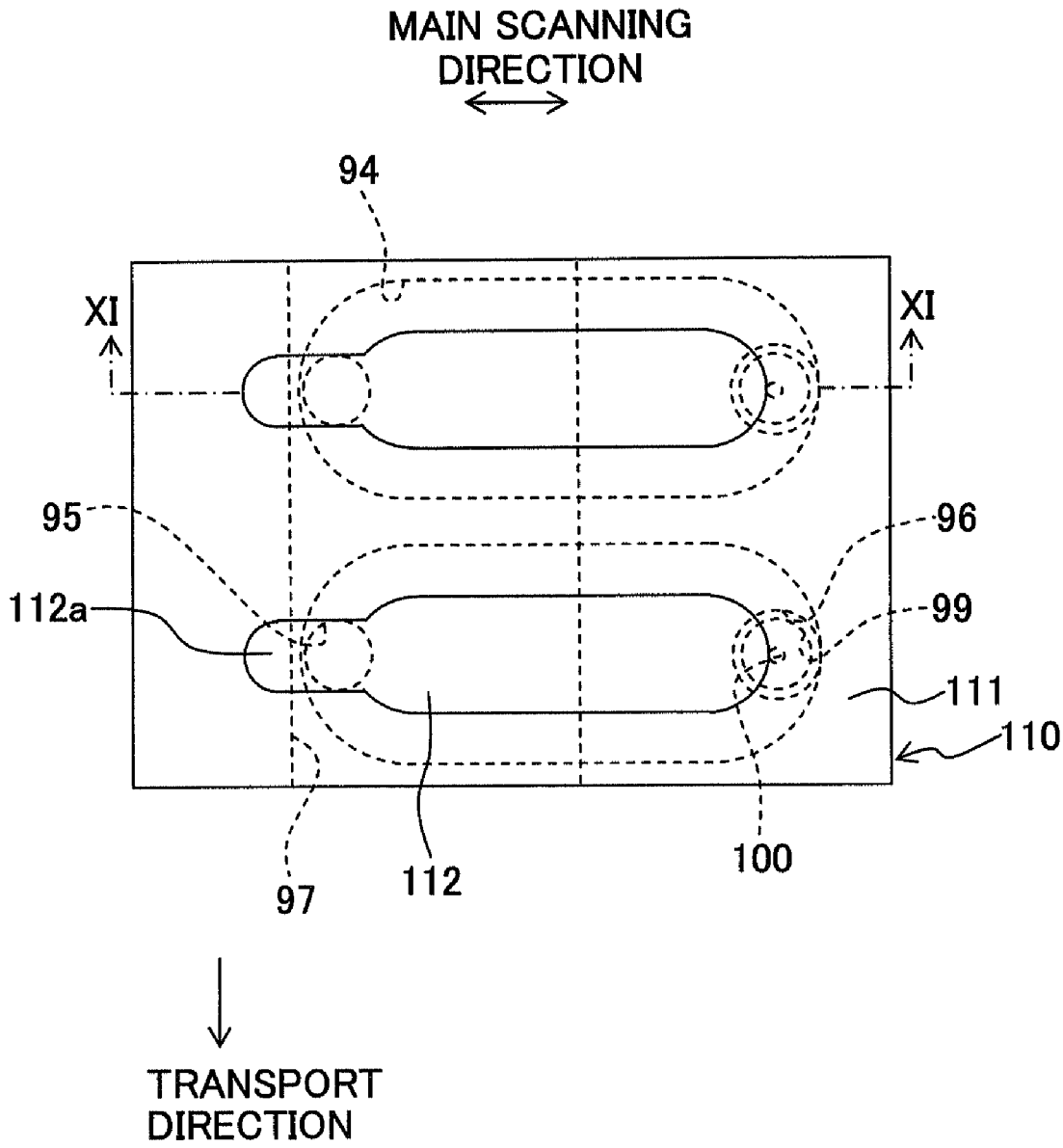
FIG. 10 shows a partial magnified view illustrating those shown in FIG. 9.
Figure 11:
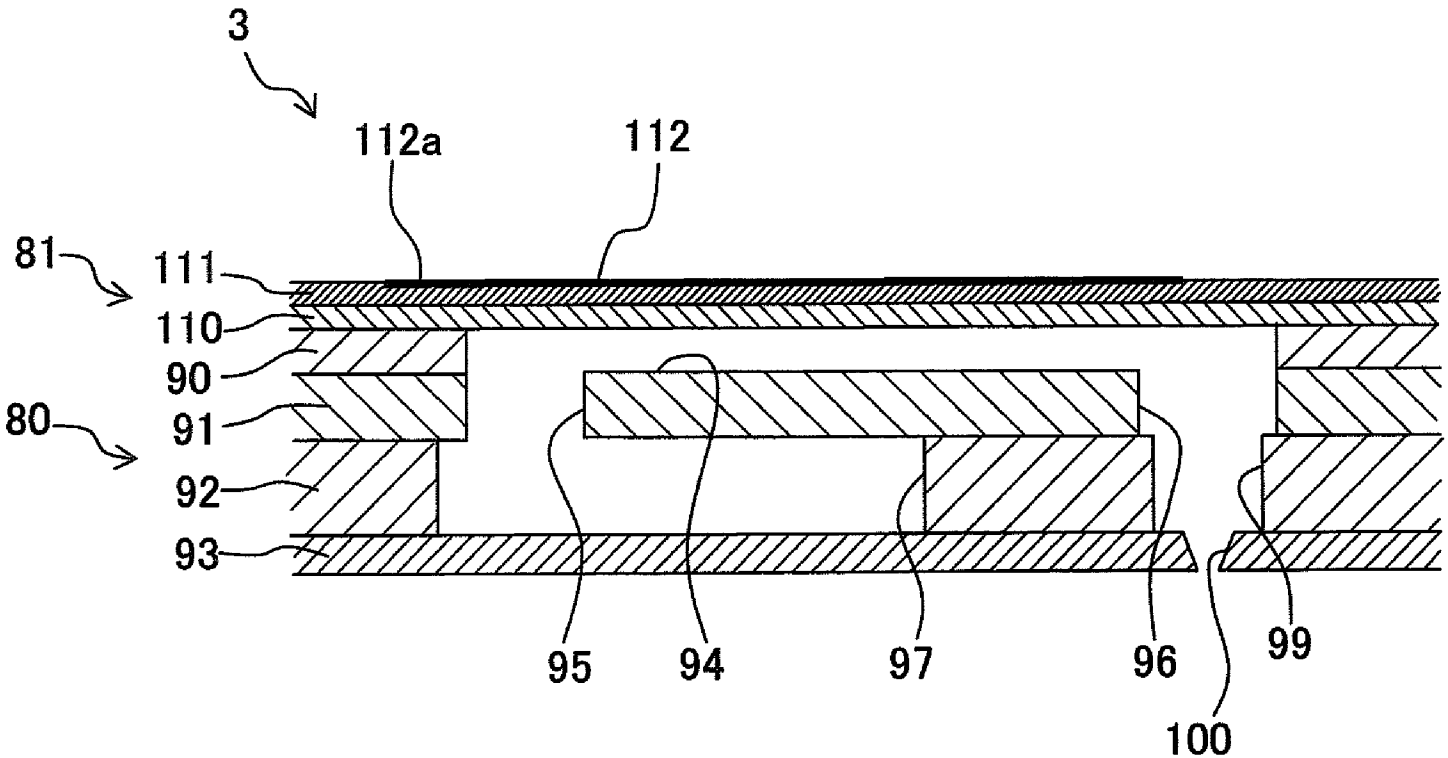
FIG. 11 shows a sectional view taken along a line XI-XI shown in FIG. 10.

Next, the structure of the serial type second head 3 will be explained in detail. FIG. 9 shows a top view illustrating the second head 3 shown in FIG. 1. FIG. 10 shows a partial magnified view illustrating those shown in FIG. 9. FIG. 11 shows a sectional view taken along a XI-XI line shown in FIG. 10. In order to depict the drawings more comprehensively, the pressure chambers 94 and the through-holes 95, 96, 99 shown in FIG. 10 are omitted from the illustration in FIG. 9, and the second nozzles 100 are magnified and illustrated with respect to those shown in FIG. 10.

As shown in FIGS. 9 to 11, the second head 3 is provided with a flow passage unit 80 which is formed with ink flow passages including the second nozzles 100 and the pressure chambers 94, and an actuator unit 81 which is arranged on the upper surface of the flow passage unit 80.

The flow passage unit 80 is provided with a cavity plate 90, a base plate 91, and a manifold plate 92 each of which is formed of a metal material such as stainless steel, and a nozzle plate 93 which is composed of a synthetic resin material. The four plates 90 to 93 are joined in a stacked state.

The nozzle plate 93 is formed with the plurality of second nozzles 100. The plurality of second nozzles 100 are arranged in the transport direction (in the vertical direction as viewed in FIG. 9) to form four nozzle arrays 101. The four nozzle arrays 101 are arranged and aligned in the main scanning direction (in the left-right direction as shown in FIG. 9). The four color inks of yellow, cyan, magenta, and black are discharged respectively from the second nozzles 100 which belong to the four nozzle arrays 101.

As shown in FIGS. 10 and 11, the cavity plate 90 is formed with the plurality of pressure chambers 94 corresponding to the plurality of second nozzles 100. Each of the pressure chambers 94 has a substantially elliptic shape in which the main scanning direction is the longitudinal direction as viewed in a plan view. The pressure chambers 94 are arranged so that the right end of each of the pressure chambers 94 is overlapped with one of the second nozzles 100. Through-holes 95, 96 are formed at positions of the base plate 91 overlapped with the both ends in the longitudinal direction of the pressure chambers 94 as viewed in a plan view respectively.

The manifold plate 92 is formed with four manifold flow passages 97 corresponding to the four nozzle arrays 101 respectively. As shown in FIGS. 9 to 11, each of the manifold flow passages 97 extends in the transport direction at the position on the left side of one of the nozzle arrays 101 of the corresponding second nozzles 100. Further, the manifold flow passages 97 are overlapped with substantially left halves of the corresponding pressure chambers 94 as viewed in a plan view. As shown in FIG. 9, one end of each of the four manifold flow passages 97 (ends on the upstream side in the transport direction: upper ends as viewed in FIG. 9) is communicated with one of the four ink supply ports 98 formed for the cavity plate 90 disposed at the uppermost layer. The four ink supply ports 98 are connected to the four second tubes 12 (see FIGS. 1 and 2) respectively. The inks, which are fed from the four first heads 2*a* to 2*d*, are supplied to the manifold flow passages 97 from the ink supply ports 98. The manifold plate 92 is formed with through-holes 99 at positions overlapped with both of the through-holes 96 of the base plate 91 and the second nozzles 100 of the nozzle plate 93 as viewed in a plan view.

As shown in FIG. 11, the manifold flow passages 97, which are connected to the ink supply ports 98, are communicated with the pressure chambers 94 via the through-holes 95 in the flow passage unit 80, and the pressure chambers 94 are further communicated with the second nozzles 100 via the through-holes 96, 99. In other words, the flow passage unit 80 is formed with a plurality of individual ink flow passages each of which extends from one of the outlets of the manifold flow passages 97 via one of the pressure chambers 94 to one of the second nozzles 100.

The actuator unit 81 has a vibration plate 110, a piezoelectric layer 111, and a plurality of individual electrodes 112. The vibration plate 110 is composed of a conductive material such as a metal material. The vibration plate 110 is joined to the upper surface of the cavity plate 90 so that the plurality of pressure chambers 94 are covered therewith. The conductive vibration plate 110 also serves as a common electrode which is provided to allow the electric field to act on the portions arranged between the vibration plate 110 and the plurality of individual electrodes 112 of the piezoelectric layer 111 as described later on. The vibration plate 110 is connected to the ground wiring of a head driver 116 (see FIG. 12), and the vibration plate 110 is always retained at the ground electric potential.

The piezoelectric layer 111 is composed of a piezoelectric ceramics material of the lead titanate zirconate system which has the ferroelectricity and which is the mixed crystal of lead titanate and lead zirconate. The piezoelectric layer 111 is arranged continuously on the upper surface of the vibration plate 110 to cover the plurality of pressure chambers 94. The piezoelectric layer 111 is previously polarized in the thickness direction thereof.

The plurality of individual electrodes 112 are provided on the upper surface of the piezoelectric layer 111 corresponding to the plurality of pressure chambers 94. Each of the individual electrodes 112 has a substantially elliptic planar shape which is one size smaller than one of the pressure chambers 94. The individual electrodes 112 are arranged, on the upper surface of the piezoelectric layer 111, at positions overlapped with substantially central portions of the pressure chambers 94 as viewed in a plan view. One end (left end as shown in FIG. 10) of each of the individual electrodes 112 in the longitudinal direction extends in the leftward direction to the position at which the end is not overlapped with one of the pressure chambers 94 as viewed in a plan view. The forward end thereof is a land 112*a*. The head driver is connected to the lands 112*a* via an unillustrated wiring member such as a flexible printed circuit (FPC). Any one of the electrodes of the predetermined driving electric potential and the ground electric potential is selectively applied from the head driver to the plurality of individual electrodes 112.

The function of the actuator unit 81 constructed as described above will be explained. When the predetermined driving electric potential is applied to any one of the plurality of individual electrodes 112 by the head driver 116, then the difference in the electric potential is generated between the one of the individual electrodes 112 to which the driving electric potential is applied and the vibration plate 110 as the common electrode which is retained at the ground electric potential, and the electric field in the thickness direction is generated at the portion of the piezoelectric layer 111 interposed by the one of the individual electrodes 112 and the vibration plate 110. In this situation, when the direction of polarization of the piezoelectric layer 111 is the same as the direction of the electric field, then the piezoelectric layer 111 is elongated in the thickness direction, and the piezoelectric layer 111 is shrunk in the in-plane direction. In accordance with the shrinkage deformation of the piezoelectric layer 111, the portion of the vibration plate 111, which is opposed to one of the pressure chambers 94 corresponding to the one of the individual electrodes 112, is deformed (subjected to the unimorph deformation) so that the portion is convex toward the one of the pressure chambers 94. In this situation, the volume of the one of the pressure chamber 94 is decreased. Therefore, the pressure of the ink contained therein is raised, and the liquid droplets of the ink are discharged from one of the second nozzles 100 communicated with the one of the pressure chambers 94.

Maintenance Mechanism

Next, the maintenance mechanism 6 will be explained in detail. As shown in FIG. 2, the maintenance mechanism 6 is provided with, for example, the first cap members 17 which are to be installed to the four first heads 2, the second cap member 18 which is to be installed to the second head 3, and the suction pump 19 which is connected to the first cap members 17 and the second cap member 18 respectively.

Both of the first cap member 17 and the second cap member 18 serve as both of the storage cap to cover the nozzles in order to avoid the drying in the waiting state of the head and the suction cap to cover the nozzles when the suction purge is executed.

Four lip sections 17*a* are formed on the upper surfaces of the first cap members 17 corresponding to the four first heads 2. Each of the lip sections 17*a* is elongated in the printing paper widthwise direction (main scanning direction), which makes tight contact with a lower surface of the corresponding one of the first heads 2 to surround the plurality of first nozzles 55. The first cap members 17 are driven in the horizontal direction by a first cap-driving mechanism 217 (see FIG. 12) between the waiting position disposed outside the printing paper transport path 8 in the printing paper widthwise direction (main scanning direction) and the capping position which is overlapped with the printing paper transport path 8.

The first heads 2 are driven by a head lifting mechanism 221 (see FIG. 12) between the liquid droplet jetting position, at which the first heads 2 are to be positioned and fixed when the liquid droplets are jetted, and the maintenance position which is separated in the upward direction (in the frontward direction as viewed in FIG. 2) from the printing paper transport path 8 as compared with the liquid droplet jetting position. When the first heads 2 are moved upwardly from the liquid droplet jetting position to the maintenance position, the first cap members 17 are moved from the waiting position to the capping position. In this situation, the first cap members 17 can cover the lower surfaces of the first heads 2. Alternatively, the first cap members 17, which are positioned at the capping position, may be further moved upwardly by the first cap-driving mechanism so that the first cap members 17 cover the lower surfaces of the first heads 2.

On the other hand, the second cap member 18 is provided in the area disposed outside the printing paper transport path 8 in the printing paper widthwise direction (main scanning direction), and the second cap member 18 is driven by a second cap driving mechanism 218 (see FIG. 12) in the upward and downward directions. A lip section 18*a* is provided on the upper surface of the second cap member 18. The lip section 18*a* makes tight contact with the lower surface of the second head 3 to surround the four nozzle arrays 101 (see FIG. 9) each including the plurality of second nozzles 100.

The first cap members 17 and the second cap member 18 are connected to a switching unit 20 respectively by means of tubes 23, 24. Further, the switching unit 20 is connected to the suction pump 19. The connection target of the suction pump 19 can be switched by the switching unit 20 between the first cap members 17 and the second cap member 18.

When the first heads 2 are used, the first cap members 17 is located at the waiting position separated away from the printing paper transport path. On the other hand, the first cap members 17 are driven to the capping position overlapped with the printing paper transport path after the first heads 2 are moved from the liquid droplet jetting position to the maintenance position disposed thereabove, during the waiting in which the first heads 2 are not used or during the execution of the suction purge. In this situation, the lip sections 17*a* of the first cap members 17 make tight contact with the lower surfaces of the first heads 2, and the plurality of nozzles 55 are covered with the first cap members 17.

When the suction purge is further performed for the first heads 2 as starting from the state in which the first cap members 17 are installed to the lower surfaces of the first heads as described above, the connection target of the suction pump 19 is switched to the first cap members 17 by means of the switching unit 20. When the suction pump 19 is operated in this state, then the spaces in the first cap members 17 are depressurized, and the inks are discharged to the first cap members 17 from the first nozzles 55 of the four first heads 2.

When the second head 3 is used, the second head 3 jets the liquid droplets against the printing paper P while making the reciprocating movement in the printing paper widthwise direction on the printing paper transport path integrally with the carriage 9. The second cap member 18, which is positioned outside the printing paper transport path, is not opposed to the second head 3. On the other hand, the second head 3 is moved to the position which is opposed to the second cap member 18 and which is disposed outside the printing paper transport path, during the waiting of the second head 3 or during the suction purge. When the second cap member 18 is driven upwardly by means of the unillustrated second cap-driving mechanism, then the lip section 18*a* makes tight contact with the lower surface of the second head 3, and the plurality of second nozzles 100, which form the four nozzle arrays 101, are covered with the second cap member 18.

When the suction purge is further performed for the second head 3 as starting from the state in which the second cap member 18 is installed to the lower surface of the second head 3 as described above, the connection target of the suction pump 19 is switched to the second cap member 18 by means of the switching unit 20. When the suction pump 19 is operated in this state, then the space in the second cap member 18 is depressurized, and the inks are discharged toward the second cap member 18 from the second nozzles 100 of the second head 3.

The fixed line type first heads 2 do not jet the liquid droplets while making the movement in the printing paper widthwise direction unlike the second head 3. It is necessary for the first heads 2 to arrange the plurality of first nozzles 55 over the entire width region of the printing paper. The number of nozzles of the first heads 2 is necessarily increased. Therefore, the first cap members 17, which cover the lower surfaces (liquid droplet jetting surfaces) of the first heads 2, have the large areal sizes as compared with the second cap member 18 which covers the lower surface (liquid droplet jetting surface) of the second head 3. Further, the first cap members 17 have large internal volumes as well.

In general, the cap members 17, 18 is formed of a soft material including, for example, resin materials and rubber materials in order to secure the tight contact performance with respect to the heads 2, 3. Further, when a material such as isobutylene-isoprene rubber and copolymer of ethylene-propylene-diene monomer (EPDM), which has a low gas permeability (which is excellent in the gas barrier performance), is adopted, the effect to avoid the drying of the ink in the nozzle is enhanced when the cap members 17, 18 function as the storage caps. However, the soft material, which is excellent in the gas barrier performance, is generally expensive. Therefore, if such a material is used for the first cap members 17 having the large areal size, the cost of the printer 1 is consequently increased. In view of the above, in this embodiment, a cheap soft material such as silicon rubber, which has a relatively high gas permeability (which is inferior in the gas barrier performance), is used for the first cap member 17. A somewhat expensive soft material such as isobutylene-isoprene rubber and EPDM, which has a low gas permeability (which is excellent in the gas barrier performance) as compared with the soft material used for the first cap member 17, is used for the second cap member 18 which is smaller than the first cap member 17.

Next, an explanation will be made with reference to a block diagram shown in FIG. 12 about the electric arrangement of the printer 1 mainly concerning the control unit 7. The control unit 7 shown in FIG. 12 comprises, for example, a central processing unit (CPU), a read only memory (ROM) in which, for example, various programs and data are stored to control the overall operation of the printer 1, and a random access memory (RAM) which temporarily stores data processed by CPU.

Figure 12:
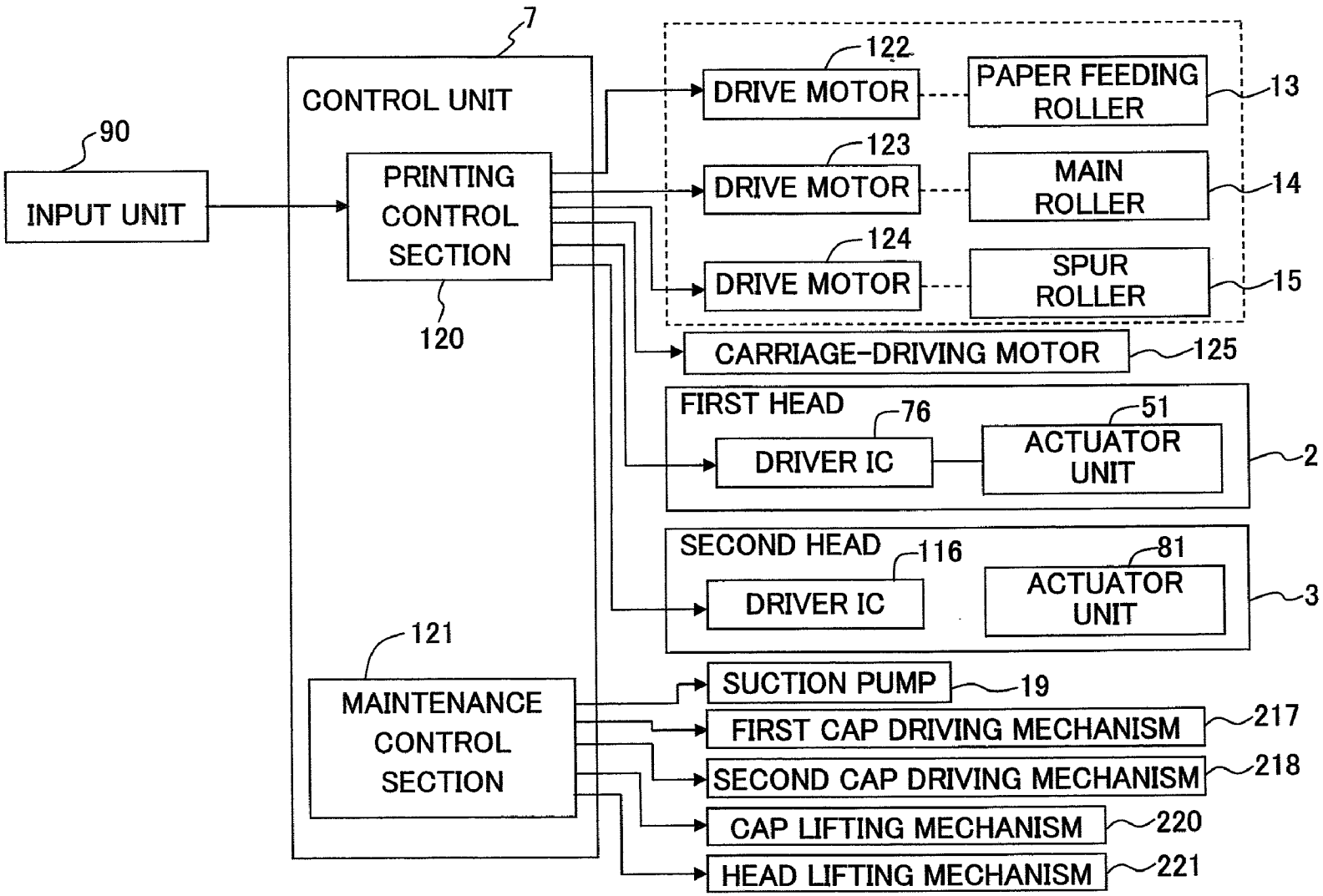
FIG. 12 shows a block diagram schematically illustrating an electric arrangement of the printer.

As shown in FIG. 12, the control unit 7 further includes a printing control section 120 which controls the printing on the printing paper P, and a maintenance control section 121 which allows the maintenance mechanism 6 to perform the maintenance including, for example, the suction purge to recover the jetting performance of the first heads 2 and the second head 3. The functions of the printing control section 120 and the maintenance control section 121 are realized by executing various control programs stored in ROM of the control unit 7 by means of CPU.

The printing control section 120 controls, for example, the head driver 76 for the first heads 2 and the head driver 116 for the second head 3, and the driving motors 122, 123, 124 for controlling the rollers 13, 14, 15 which transport the printing paper P and which are included in the printing paper transport mechanism 5 respectively on the basis of the data inputted from an input device 130 such as PC so that the image or the like is printed on the printing paper P.

The printing control section 120 is capable of selecting a mode in which the printing is performed on the printing paper P by using only the serial type second head 3 or the fixed line type first heads 2, and another mode in which the printing is performed by simultaneously using the both heads.

For example, when the low resolution printing such as the text printing is requested from the input device 130, the printing control section 120 controls the head driver 116 for the fixed line type first heads 2 to jet the liquid droplets at once from the large number of first nozzles 55 of the first heads 2. Accordingly, it is possible to print the letters and the image on the printing paper P at a high speed.

On the other hand, when the high resolution printing, in which the high definition image is printed, is requested from the input device 130, the printing control section 120 controls the head driver 76 for the serial type second head 3 and the carriage-driving motor 125 for driving the carriage. The liquid droplets are jetted at appropriate timings from the plurality of second nozzles 100, while appropriately adjusting the movement velocity (scanning velocity) in the printing paper widthwise direction of the second head 3. Accordingly, the high definition image can be printed on the printing paper P, although the printing speed is lowered as compared with the printing performed by the first heads 3.

Further, the printing control section 120 is also capable of printing, for example, the image by simultaneously controlling the carriage-driving motor 125 and the head drivers 76, 115 for both of the heads 2, 3 to jet the liquid droplets from both of the first heads 2 and the second head 3 against one sheet of the printing paper P. In this procedure, a coarse image is formed on the printing paper P by jetting the liquid droplets from the large number of first nozzles 55 of the first heads 2, and the liquid droplets are also jetted from the plurality of second nozzles 100 of the second head 3 so that image portions, which cannot be printed by only the first nozzles 55, are filled. Accordingly, the high definition image can be printed at a relatively fast printing speed.

The maintenance control section 121 controls the first cap driving mechanism 217 for driving the first cap members 17 and the second cap driving mechanism 218 for driving the second cap member 18 (both mechanisms are shown in FIG. 12) so that the first cap members 17 and the second cap member 18 are installed to the first heads 2 and the second head 3, when the first heads 2 and the second head 3 are in the waiting state or when the suction purge is performed for the heads 2, 3. Further, when it is required to perform the suction purge, the maintenance control section 121 controls the suction pump 19 while the cap members 17, 18 are installed to the heads 2, 3 to suck and discharge the inks toward the cap members 17, 18 from the first nozzles 55 of the first heads 2 and the second nozzles 100 of the second head 3.

In this arrangement, the maintenance control section 121 is capable of allowing the maintenance mechanism 6 to perform the suction purge for both of the first heads 2 and the second head 3, and the maintenance control section 121 is also capable of allowing the maintenance mechanism 6 to perform the suction purge for only any one of the first and second heads. For example, when it is assumed that the jetting failure arises in only the nozzle or nozzles of one of the first and second heads, it is appropriate that the suction purge is performed for only the concerning head. It is unnecessary to perform the suction purge for the other head in which it is assumed that the jetting failure does not arise. As described above, the suction purge can be performed for only the head in which the jetting failure arises. Therefore, it is possible to avoid the suction of any excessive ink.

The serial type second head 3 is movable in the printing paper widthwise direction. Therefore, when the jetting failure arises in a part of the second nozzles 100, the second nozzle or nozzles 100, in which the jetting failure arises, can be supplemented or complemented by controlling the scanning velocity of the carriage 9 and/or the jetting timings of the other second nozzles 100 in which the jetting failure does not arise. Therefore, even when the jetting failure is caused, it is not necessarily indispensable that the suction purge should be performed immediately. However, the fixed line type first head 2 jets the liquid droplets while being positioned and fixed, and hence it is impossible to complement a certain first nozzle 55 in which the jetting failure arises, by using any other normal first nozzle 55. Therefore, when the jetting failure arises in the nozzles of both of the first head 2 and the second head 3, it is also allowable to perform the suction purge for only the first head 2, when the degree of the jetting failure of the second head 3 is insignificant.

The following effect is obtained by the printer 1 of this embodiment constructed as described above. As shown in FIGS. 1 and 2, the serial type second head 3 is connected to the ink cartridge 4 via the fixed line type first heads 2, and the ink is supplied to the second head 3 via the first heads 2. When one ink cartridge 4 and two heads 2, 3 are connected in series as described above, it is possible to shorten the total length of the tubes (total length of the first tubes 11 and the second tubes 12) as compared with a case in which one ink cartridge 4 and two heads 2, 3 are connected by means of distinct tubes respectively (parallel connection). Therefore, it is possible to reduce the cost required for the tubes. Further, it is also possible to suppress the increase in viscosity of the ink in the tubes and the invasion of air bubbles into the tubes.

The drying of the ink in the nozzle tends to occur in the fixed line type first head 2 arranged on the side of the ink cartridge 4 (arranged on the upstream side in the ink supply direction) as compared with the serial type second head 3. Further, since the first heads 2 are the fixed line type heads, the influence, which is exerted on the jetting performance by the viscosity-increased ink and the air bubbles, is large, and the first heads 2 are weak against the increase in viscosity of the ink and the contamination with air bubbles.

As described above, the first cap member 17, which is to be installed to the fixed line type first head 2, has the areal size which is larger than that of the second cap member 18 which is to be installed to the serial type second head 3. Therefore, the tight contact performance of the first cap member 17 with respect to the head is inferior as compared with the second cap member 18. Simultaneously, the first cap member 17 has the internal volume (volume of the hollow portion) which is larger than that of the second cap member 18. Therefore, even when the cap members 17, 18 reliably make tight contact with the heads 2, 3, the drying of the ink (increase in viscosity) tends to occur in the first nozzles 55 covered with the first cap member 17 as compared with the second nozzles 100 covered with the second cap member 18. Further, when the first cap member 17 is formed of the material having the high gas permeability as compared with the second cap member 18 as described above, the increase in viscosity tends to occur more easily in the first nozzles 55 covered with the first cap member 17. In other words, it is affirmed that the increase in viscosity of the ink originally tends to arise in the nozzles of the fixed line type first head 2 as compared with the serial type second head 3.

In the case of the serial type second head 3 which is movable in the printing paper widthwise direction, as described above, even when the jetting failure arises in a part of the second nozzles 100, the second nozzle 100, in which the jetting failure arises, can be complemented by controlling the scanning velocity of the carriage 9 and/or the jetting timing of any other second nozzle 100 in which the jetting failure does not arise. The serial type head is movable by itself, for which it is unnecessary to provide a large number of nozzles as compared with the fixed line type head. Therefore, it is allowable that the number of nozzles of the serial head is relatively small. Even when the purge is performed to discharge the viscosity-increased ink and the air bubbles from the second nozzles 100 in order to dissolve or eliminate the jetting failure, it is enough to use a small amount of the ink discharged from the second nozzles 100 during the purge.

However, in the case of the fixed line type first head 2, it is impossible to complement the first nozzle 55 in which the jetting failure arises, with any other normal first nozzle 55. Therefore, in order to dissolve the jetting failure of the first nozzle 55, it is necessary to allow the maintenance mechanism 6 to perform the suction purge. However, in general, the number of the first nozzles 55 of the first head 2 is extremely large as compared with the second nozzles 100 of the second head 3. Therefore, an extremely large amount of the ink is discharged from the first nozzles 55 during the suction purge.

When the two heads 2, 3 are arranged in series, the length of the tubes, through which the ink is allowed to pass until arrival at the far head from the ink cartridge 4, is elongated for the far head which is positioned on the more downstream side in the ink supply direction while being separated farther from the ink cartridge 4. Therefore, the ink having a high degree of the increase in viscosity and/or the ink containing a large amount of air bubbles is/are supplied to the far head disposed on the downstream side. In view of the above, in the printer 1 of this embodiment, the fixed line type first heads 2, in which the nozzle drying tends to arise and which is weak against the viscosity-increased ink and the air bubbles, is arranged on the near side of the ink cartridge 4 (on the upstream side in relation to the ink supply). Accordingly, it is possible to suppress the occurrence of the jetting failure in the first nozzles 55 of the first heads 2, and it is possible to decrease the frequency of the suction purge (operation for recovering the jetting performance) to be performed by the maintenance mechanism 6.

Next, an explanation will be made about modified embodiments in which various modifications are applied to the embodiment described above. However, those constructed in the same manner as those of the embodiment described above are designated by the same reference numerals, any explanation which will be appropriately omitted.

Figure 13:
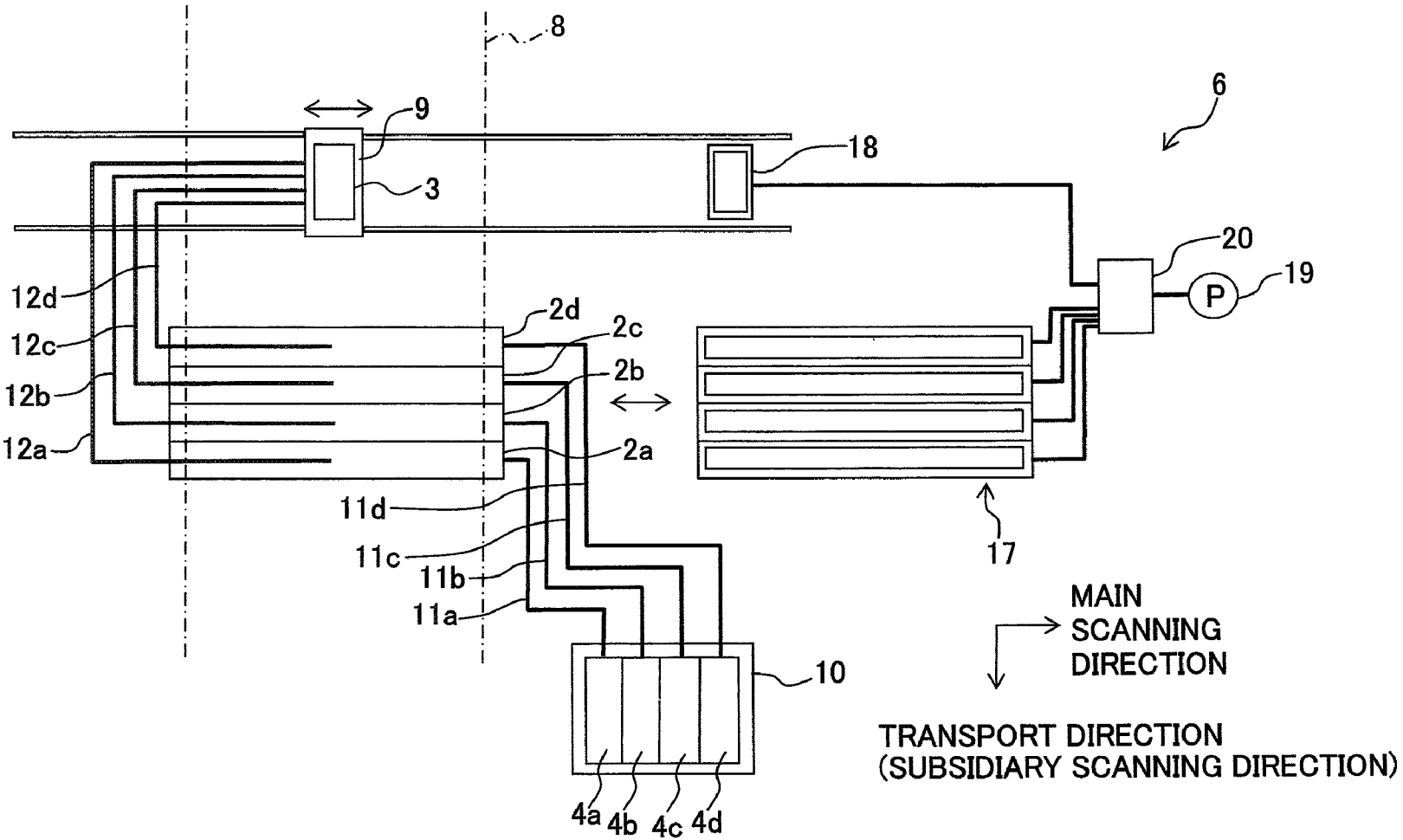
FIG. 13 shows a side view illustrating a schematic arrangement of a printer according to a modified embodiment.

In the embodiment described above, each of the second tubes 12, which are connected to the second head 3, is connected to the one end of one of the first heads 2 in the longitudinal direction (see FIG. 2). However, as shown in FIG. 13, the second tubes 12, which are connected to the serial type second head 3, may be connected to central portions of the first heads 2 in the longitudinal direction (direction of movement of the second head 3 (main scanning direction)).

When the second tubes 12 are connected to the central portions of the first heads 2 in the longitudinal direction as described above, it is possible to shorten the lengths of the second tubes 12 as compared with the case in which the one end of each of the first heads 2 in the longitudinal direction is the connection position (FIG. 1). In the case of the form shown in FIG. 1, the amounts of bending of the second tubes 12 are extremely large when the second head 3 is moved to the left end in the movable range (one end, of the first heads 2, disposed on the side of the connection to the second tubes 12). As compared with the above, when the second tubes 12 are connected to the central portions of the first heads 2 in the longitudinal direction as shown in FIG. 13, the amounts of bending of the second tubes 12 are decreased when the second head 3 is moved to the positions of the both ends of the movable range. Therefore, it is possible to decrease the space which is required to allow the bent second tubes 12 to escape.

In the embodiment described above, the first cap members 17 and the second cap member 18 of the maintenance mechanism 6 serve as both of the storage caps for avoiding the nozzle drying and the suction caps for the suction purge. However, the first cap member and the second cap member may be exclusively used for avoiding the nozzle drying. In this case, suction caps, which are exclusively used for the suction purge and which are distinct from the first cap members and the second cap member, may be provided. Alternatively, it is also allowable to perform the pressurizing purge in which the inks are forcibly discharged from the nozzles by applying the back pressure with a pump from the upstream side in the supply direction by means of the maintenance mechanism. When the pressurizing purge is performed, it is unnecessary to provide the suction cap.

In the embodiment described above, the plurality of first nozzles 55 of the first heads 2 are aligned linearly in the direction (main scanning direction) parallel to the printing paper widthwise direction (see FIG. 6). However, the object, to which the present invention is applicable, is not limited to such a form. That is, the present invention is also applicable to any fixed line head in which the nozzle arrays are curved a little or the nozzle arrays somewhat meander provided that the liquid droplets are jetted in a state of being positioned and fixed at a predetermined position. In the embodiment described above, the suction purge is performed for all of the four first heads 2*a* to 2*d*, simultaneously. However, the suction purge may be performed for any one of the first heads 2*a* to 2*d*. In this case, it is possible to perform the suction purge only for one head of the first heads jetting a certain color of ink, and it is possible to avoid the suction of any excessive ink. When the second cap member includes a plurality of caps each of which covers one of the nozzle arrays, independently, the suction purge can be performed for one of the nozzle arrays jetting a certain color of ink to avoid the suction of any excessive ink.

In the embodiments described above, the present invention is applied to the printer of the ink-jet system in which the ink is jetted against the recording paper to record, for example, the image. However, the application objective of the present invention is not limited to the printer as described above. That is, the present invention is applicable to various liquid droplet-jetting apparatuses for jetting various types of liquids other than the ink against the objective depending on the way of use. The present invention is also applicable, for example, to an apparatus for forming a wiring pattern by transferring, to a substrate, a conductive liquid dispersed with metal nanoparticles, an apparatus for producing a DNA chip by using a solution dispersed with DNA, an apparatus for producing a display panel by using a solution dispersed with an EL light emission material such as an organic compound, and an apparatus for producing a color filter for the liquid crystal display by using a liquid dispersed with a pigment for the color filter.

What is claimed is:

1. A liquid droplet jetting apparatus which jets a droplet of a liquid onto an object, the liquid droplet jetting apparatus comprising:

a first head of a fixed line type in which a plurality of first nozzles arranged in one direction is formed and which jets the droplet of the liquid while being positioned and fixed at a predetermined position;

a second head of a serial type in which a plurality of second nozzles is formed and which is capable of reciprocating in a predetermined scanning direction;

a first cap which is attachable to the first head to cover the plurality of first nozzles;

a second cap which is attachable to the second head to cover the second nozzles;

a liquid tank which stores the liquid to be supplied to the first head and the second head;

a first tube which connects the first head and the liquid tank; and a second tube which connects the second head and the liquid tank, wherein the first head is connected to one end of the first tube and the liquid tank is connected to the other end of the first tube; and the second head is connected to the first head by the second tube such that the second head is connected to the liquid tank via the first head.

2. The liquid droplet jetting apparatus according to claim 1, wherein an internal volume of the first cap is larger than an internal volume of the second cap.

3. The liquid droplet jetting apparatus according to claim 1, wherein the first cap is formed of a material having a gas permeability higher than that of a material forming the second cap.

4. The liquid droplet jetting apparatus according to claim 1, wherein the first tube has a bendability smaller than that of the second tube.

5. The liquid droplet jetting apparatus according to claim 1, wherein the first head includes:

a head body in which the plurality of first nozzles is formed; and a liquid storage member which is provided integrally with the head body, which is connected to the liquid tank by the first tube, and which stores the liquid supplied from the liquid tank; and the second head and the liquid storage member of the first head are connected by the second tube.

6. The liquid droplet jetting apparatus according to claim 1, wherein the second tube, which is connected to the second head, is connected to a central portion of the first head in the scanning direction.

7. The liquid droplet jetting apparatus according to claim 1, further comprising a purge mechanism which has a cap-driving mechanism which drives the first and second caps so that the first and second caps are capable of coming into contact with and separating away from the first and second heads, respectively, and a sucking mechanism connected to the first and second caps to evacuate a first space and a second space, the first space being defined by the first cap and a first nozzle surface formed with the first nozzles of the first head and a second space being defined by the second cap and a second nozzle surface formed with the second nozzles of the second head.

8. The liquid droplet jetting apparatus according to claim 7, wherein a volume of the first space is larger than a volume of the second space.

9. The liquid droplet jetting apparatus according to claim 8, wherein the sucking mechanism has a suction pump, and a switch which switches a connection target of the suction pump between the first space and the second space.

10. The liquid droplet jetting apparatus according to claim 3, wherein the first cap is formed of silicon rubber, and the second cap is formed of isobutylene-isoprene rubber or copolymer of ethylene-propylene-diene monomer.

11. The liquid droplet jetting apparatus according to claim 1, wherein a number of the first nozzles is more than a number of the second nozzles.

12. The liquid droplet jetting apparatus according to claim 11, wherein the first nozzles of the first head cover a range entirely in which the second head is capable of reciprocating in the scanning direction.

13. The liquid droplet jetting apparatus according to claim 1, wherein the liquid is an ink, and each of the first and second heads is a piezoelectric type ink-jet head which jets a droplet of the ink onto the object.

* * * * *